US010249418B2

(12) United States Patent
Zhang et al.

(10) Patent No.: US 10,249,418 B2
(45) Date of Patent: Apr. 2, 2019

(54) PERMANENT MAGNET MATERIAL AND METHOD FOR PREPARING THE SAME

(71) Applicant: YANSHAN UNIVERSITY, Qinhuangdao (CN)

(72) Inventors: Xiangyi Zhang, Qinhuangdao (CN); Xiaohong Li, Qinhuangdao (CN); Wenpeng Song, Qinhuangdao (CN); Guangwei Huang, Qinhuangdao (CN); Li Lou, Qinhuangdao (CN); Fuchen Hou, Qinhuangdao (CN); Qian Zhang, Qinhuangdao (CN)

(73) Assignee: YANSHAN UNIVERSITY, Qinhuangdao (CN)

( * ) Notice: Subject to any disclaimer, the term of this patent is extended or adjusted under 35 U.S.C. 154(b) by 0 days.

(21) Appl. No.: 15/757,888

(22) PCT Filed: Sep. 9, 2016

(86) PCT No.: PCT/CN2016/098541
§ 371 (c)(1),
(2) Date: Mar. 6, 2018

(87) PCT Pub. No.: WO2017/041741
PCT Pub. Date: Mar. 16, 2017

(65) Prior Publication Data

US 2018/0174722 A1 Jun. 21, 2018

(30) Foreign Application Priority Data

Sep. 10, 2015 (CN) ..... 2015 1 0572046

(51) Int. Cl.
*H01F 1/055* (2006.01)
*H01F 41/02* (2006.01)

(52) U.S. Cl.
CPC ..... *H01F 1/0556* (2013.01); *H01F 1/055* (2013.01); *H01F 41/0266* (2013.01); *H01F 41/0293* (2013.01)

(58) Field of Classification Search
None
See application file for complete search history.

(56) References Cited

U.S. PATENT DOCUMENTS

2004/0025974 A1 2/2004 Lee et al.
2006/0054245 A1 3/2006 Liu et al.
(Continued)

FOREIGN PATENT DOCUMENTS

CN 1735947 A 2/2006
CN 1961388 A 5/2007
(Continued)

OTHER PUBLICATIONS

Nanotechnology'701 (Nanotechnology, 2008, vol. 19, 335701. (Year: 2008).*
(Continued)

*Primary Examiner* — Xiaowei Su
(74) *Attorney, Agent, or Firm* — Oblon, McClelland, Maier & Neustadt, L.L.P.

(57) ABSTRACT

A permanent magnet material and a method thereof. The permanent magnet material comprises one or more rare earth elements and one or more transition metal elements, wherein the atomic percentage of the one or more rare earth elements is less than or equal to 13%, and the permanent magnet material has a maximum magnetic energy product of greater than or equal to 18 MGOe.

19 Claims, 10 Drawing Sheets

(56) References Cited

U.S. PATENT DOCUMENTS

| | | | |
|---|---|---|---|
| 2012/0153212 | A1 | 6/2012 | Liu |
| 2016/0268025 | A1 | 9/2016 | Nagata |

FOREIGN PATENT DOCUMENTS

| | | | |
|---|---|---|---|
| CN | 101090015 | A | 12/2007 |
| CN | 101593591 | A | 12/2009 |
| CN | 102496437 | A | 6/2012 |
| CN | 102744406 | A | 10/2012 |
| CN | 104674115 | A | 6/2015 |
| JP | 63-188917 | A | 8/1988 |
| JP | 7-240307 | A | 9/1995 |
| JP | 2002-322502 | A | 11/2002 |
| JP | 2009-260290 | A | 11/2009 |
| WO | WO 2008/044776 | A1 | 4/2008 |

OTHER PUBLICATIONS

Thesis of Mirva Eriksson, 2010. (Year: 2010).*
Zhang (IEEE Transactions on Magnetics, 2007, vol. 43, p. 3494-3496. (Year: 2007).*
International Search Report dated Dec. 14, 2016 in PCT/CN2016/098541 filed Sep. 9, 2016.
Office Action dated Aug. 21, 2018 in corresponding Japanese Patent Application No. 2018-512866 (with English Translation), 7 pages.

* cited by examiner

PERMANENT MAGNET MATERIAL AND METHOD FOR PREPARING THE SAME

TECHNICAL FIELD

The present disclosure belongs to the field of magnet materials, and particularly relates to a permanent magnet material and method for preparing the same.

BACKGROUND ART

Currently, high-performance permanent magnet materials occupy an important position in the national economy and high-tech development. With the development of emerging high-tech industries such as wind power generation, hybrid and pure electric vehicles, the demand for high-performance permanent magnet materials is increasing, and the research and development on such materials have shown an increasingly important strategic position.

Rare earth permanent magnet material is a type of high-performance permanent magnet materials formed by rare earth RE (Sm, Nd, Pr, etc.) and transition metal M (Fe, Co) and the like. In the periodic table of elements, rare earth element is a general term for 15 lanthanides. It should be pointed out that the Group IIIB elements—scandium and yttrium are often included as rare earth elements. The first generation of rare earth permanent magnet materials represented by $SmCo_5$ as developed in the 1960s and the second generation of rare earth permanent magnet materials represented by $Sm_2Co_{17}$ as developed in the 1970s both have good permanent magnet properties. In 1983, Sakawa Masahito et al conducted extensive experiments on RE-Fe—X ternary alloy, and found that Nd—Fe—B magnet, which belongs to the third generation of rare earth permanent magnet materials, has a high maximum energy product. Nd—Fe—B magnet has a higher maximum energy product and a lower price, but has a lower Curie temperature and a poorer high temperature property as compared to Sm—Co permanent magnet.

In the early 90s of last century, people put forward the use of nano-technology to constitute nano-scale soft and hard magnetic phases into "an exchange coupled permanent magnet", which opened a new idea for "next generation" of super strong permanent magnet materials. The theoretical energy product of this type of permanent magnet material reaches as high as 100 MGOe, far exceeding the highest energy product of the current "permanent magnet king" $Nd_2Fe_{14}B$, which is 64 MGOe. In addition, this type of permanent magnet material contains a large amount of cheap soft magnetic phase (such as Fe or FeCo etc.), and has a low rare earth content, and thus has a low cost and a good corrosion resistance.

One of the key indexes to measure the property of permanent magnet materials is the maximum energy product. Over the past 20 years, various types of permanent magnet materials have been prepared using various techniques such as mechanical alloying, rapid quenching, hot press deformation (e.g., die-upset) and the like.

Chinese patent CN1985338A discloses a bulk anisotropic nanocomposite rare earth permanent magnet. In this patent, a permanent magnet material is prepared by die-upset technique. As the patent uses rare earth-rich permanent magnet powder as a raw material, the permanent magnet material has a high content of rare earth elements and a relatively high cost.

Chinese patent CN1735947A discloses a composite rare earth permanent magnet material. In this patent, a rare earth alloy powder is prepared by melt spinning process, and then subjected to rapid hot press, to result in a $SmCo_{9.5}$ permanent magnet material, which has a maximum energy product of 11.1 MGOe.

U.S. Pat. No. 2012/0153212 discloses a nanocomposite permanent magnet material. In this patent, a permanent magnet material is prepared by die-upset technique. The permanent magnet material is made from $SmCo_5$+20 wt % $Fe_{65}Co_{35}$, and has a maximum energy product of 19.2 MGOe.

The prior art still needs permanent magnet materials with lower cost and better property, especially permanent magnet materials with a lower rare earth content and a higher maximum energy product.

CONTENT OF THE INVENTION

Directed to one or more problems existing in the prior art, an object of the present disclosure is to provide a permanent magnet material. Another object of the present disclosure is to provide a permanent magnet material with a low content of rare earth elements. Still another object of the present disclosure is to provide a permanent magnet material with a higher maximum energy product. Still another object of the present disclosure is to provide a method for preparing a permanent magnet material.

The present disclosure achieves one or more of the above objects through the following technical solutions.

In an embodiment, the present disclosure provides a permanent magnet material comprising one or more rare earth elements and one or more transition metal elements, wherein the one or more rare earth elements have an atomic percentage of less than or equal to 13%, and the permanent magnet material has a maximum energy product of greater than or equal to 18 MGOe.

In a preferred embodiment, the present disclosure provides a permanent magnet material having a maximum energy product of less than 40 MGOe, preferably less than or equal to 35 MGOe, more preferably less than or equal to 30 MGOe.

In a preferred embodiment, the present disclosure provides a permanent magnet material having a maximum energy product of 20-28 MGOe, preferably 22-28 MGOe, more preferably 24-28 MGOe, still more preferably 25.5-27.5 MGOe.

In a preferred embodiment, the present disclosure provides a permanent magnet material, wherein the atomic percentage of the one or more rare earth elements is greater than or equal to 5%, preferably greater than or equal to 6%.

In a preferred embodiment, the present disclosure provides a permanent magnet material, wherein the atomic percentage of the one or more rare earth elements is 5-13%, preferably 6-12%, still preferably 7-9%, more preferably 7-8%, still more preferably 7.3-7.6%.

In a preferred embodiment, the present disclosure provides a permanent magnet material having an intrinsic coercivity of 2-10 kOe, preferably 3-7 kOe, more preferably 4-6 kOe.

In a preferred embodiment, the present disclosure provides a permanent magnet material having a saturation magnetization of 10-16 kGs, preferably 11-15 kGs, more preferably 13-14 kGs.

In a preferred embodiment, the present disclosure provides a permanent magnet material having a remanent magnetization of 9-14 kGs, preferably 11-13 kGs, more preferably 12-13 kGs.

In a preferred embodiment, the present disclosure provides a permanent magnet material having a remanence ratio of 0.8-1, preferably 0.85-1, still preferably 0.95-1, more preferably 0.8-0.95, still more preferably 0.9-0.95.

In a preferred embodiment, the present disclosure provides a permanent magnet material which does not contain a rare earth-rich phase.

In an embodiment, the present disclosure provides a method for preparing a permanent magnet material, which comprises subjecting a hot press unit to hot press deformation, wherein the hot press unit is a permanent magnet blank and a mold in which the permanent magnet blank is placed; during the hot press deformation, the hot press unit is subjected to cooling treatment at both ends along the hot press pressure direction.

In an embodiment, the present disclosure provides a method for preparing a permanent magnet material, which comprises, during the hot press deformation, heating the hot press unit prior to deformation of the hot press unit, while cooling both ends of the hot press unit in a certain cooling rate, so that the temperature of the middle part of the hot press unit reaches a hot deformation temperature and the temperature at both ends of the hot press unit is lower than the hot deformation temperature;

preferably, the hot deformation temperature is 400-900° C.;

preferably, the temperature at both ends of the hot press unit is 300-600° C., preferably 300-500° C., more preferably 350-450° C. lower than the hot deformation temperature;

preferably, the temperature at both ends of the hot press unit is 100-400° C., preferably 150-350° C., more preferably 200-300° C.

In an embodiment, the present disclosure provides a method for preparing a permanent magnet material, wherein the cooling treatment is maintained during the hot press deformation.

In an embodiment, the present disclosure provides a method for preparing a permanent magnet material, wherein the permanent magnet blank has a density of 4-10 g/cm$^3$, preferably 5-8 g/cm$^3$, more preferably 6-7.2 g/cm$^3$.

In an embodiment, the present disclosure provides a method for preparing a permanent magnet material, wherein the mold is a cylindrical body having two open ends, and a generatrix of an outer wall of the cylindrical body is a concave curve, a straight line or a convex curve.

In an embodiment, the present disclosure provides a method for preparing a permanent magnet material, wherein the concave curve or convex curve is an arc or a parabola.

In an embodiment, the present disclosure provides a method for preparing a permanent magnet material, wherein the mold is made of a metal, preferably a superalloy, more preferably GH4169 or GH2025 High temperature alloy steel.

In an embodiment, the present disclosure provides a method for preparing a permanent magnet material, comprising one or more of the following steps:

1) mixing a permanent magnet powder and a soft magnet powder;

2) molding a mixture of the permanent magnet powder and the soft magnet powder into a permanent magnet blank;

3) placing the permanent magnet blank in a mold to obtain a hot press unit;

4) subjecting the hot press unit to hot press deformation;

5) subjecting the hot press unit after hot press deformation to stress relief treatment.

Unless otherwise specified, the term "deformation" used herein refers to a negative deformation in a direction parallel to the pressure direction. In an embodiment, the deformation=$(l_0-l)/l_0$, wherein $l_0$ and l are respectively the height of the hot press unit in a direction parallel to the pressure direction before and after the hot press deformation.

The permanent magnet material according to the present disclosure has the magnetic properties as recited in the present disclosure in at least one direction, including one or more selected from maximum energy product, saturation magnetization, remanent magnetization, remanence ratio or intrinsic coercivity.

In the present disclosure, intrinsic coercivity (symbol: $H_{in}$), unit: oersted (Oe), 1 Oe=1000/4π A/m, 1 kOe=1000 Oe.

Saturation magnetization (symbol: 4πMs), unit Gs, 1 Gs=$10^3$ A/m.

Remanent magnetization (briefed as remanence, symbol: 4 πMr), unit: Gs, 1 Gs =$10^3$ A/m, 1 kGs=1000 Gs. (The unit Gs can also be abbreviated as G; kGs can be abbreviated as kG).

Remanence ratio refers to a ratio of remanent magnetization to saturation magnetization, i.e., Mr/Ms.

Maximum energy product (symbol: $BH_{max}$), unit: MGOe, 1 MGOe=100/4π kJ/m$^3$.

In the present disclosure, the atomic percentages of rare earth elements in the permanent magnet material are calculated according to the weight percentages of the soft magnet powder and the permanent magnet powder in the raw material, and if there is any difference between them, the weight percentages of the soft magnet powder and the permanent magnet powder in the raw materials are taken as the standard.

In the present disclosure, the term "more" refers to two or more.

BENEFICIAL EFFECTS OF THE PRESENT INVENTION

According to the present disclosure, a permanent magnet material with excellent properties is prepared using less rare earth raw materials.

The permanent magnet material of the present disclosure has a lower atomic percentage of the rare earth elements, but it exhibits higher maximum energy product, saturation magnetization, remanent magnetization, intrinsic coercivity or remanence ratio.

DESCRIPTION OF FIGURES

The figures described herein act to provide a further understanding of the present disclosure and constitute a part of the present application. In the figures.

Figure 1:
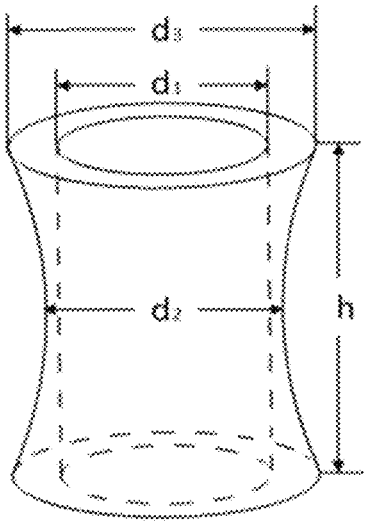
FIG. 1 is a schematic diagram of the mold in Examples 1-9.

Reference signs includes: cooling water inlet (1*a*, 1*b*), electrode (2*a*, 2*b*), carbide indenter (4*a*, 4*b*), hot press unit 5, cooling water out let (6*a*, 6*b*), height of the cylinder (h), inner diameter of the cylinder (d1), outer diameter at both ends of the cylinder (d3), outer diameter at middle part of the cylinder (d2).

MODES OF CARRYING OUT THE INVENTION

The present disclosure provides the following specific embodiments as well as all possible combinations among them. For the sake of brevity, various specific combinations of the embodiments are not described in the present application one by one, but it shall be regarded that all the possible combinations of the specific embodiments have been specifically described and disclosed in the present application.

In an embodiment, the present disclosure provides a permanent magnet material comprising one or more rare earth elements and one or more transition metal elements, wherein the one or more rare earth elements have an atomic percentage of the less than or equal to 13%, and the permanent magnet material has a maximum energy product of greater than or equal to 18 MGOe.

In a preferred embodiment, the present disclosure provides a permanent magnet material having a maximum energy product of less than 40 MGOe, preferably less than or equal to 35 MGOe, more preferably less than or equal to 30 MGOe.

In a preferred embodiment, the present disclosure provides a permanent magnet material having a maximum energy product of 20-28 MGOe, preferably 22-28 MGOe, still preferably 24-28 MGOe, more preferably 25-28 MGOe, still more preferably 25.5-27.5 MGOe.

In a preferred embodiment, the present disclosure provides a permanent magnet material, wherein the atomic percentage of the one or more rare earth elements is greater than or equal to 5%, preferably greater than or equal to 6%.

In a preferred embodiment, the present disclosure provides a permanent magnet material, wherein the atomic percentage of the one or more rare earth elements is 5-13%, preferably 6-12%, still preferably 7-9%, more preferably 7-8%, still more preferably 7.3-7.6%.

In a preferred embodiment, the present disclosure provides a permanent magnet material having an intrinsic coercivity of 2-10 kOe, preferably 3-7 kOe, more preferably 4-6 kOe.

In a preferred embodiment, the present disclosure provides a permanent magnet material having a saturation magnetization of 10-16 kGs, preferably 11-15 kGs, more preferably 13-14 kGs.

In a preferred embodiment, the present disclosure provides a permanent magnet material having a remanent magnetization of 9-14 kGs, preferably 11-13 kGs, more preferably 12-13 kGs.

In a preferred embodiment, the present disclosure provides a permanent magnet material having a remanence ratio of 0.8-0.95, preferably 0.8-0.9, 0.85-0.9 or 0.9-0.95.

In a preferred embodiment, the present disclosure provides a permanent magnet material, wherein the permanent magnet material has magnetic anisotropy, preferably, the permanent magnet material has a magnetic property parameter in one direction which is 1.1 times or more, preferably 1.3 times or more, more preferably 1.5 times or more of the magnetic property parameter in another direction. The magnetic property parameter may be one or more selected from intrinsic coercivity, saturation magnetization, remanent magnetization, remanence ratio and maximum energy product.

In a preferred embodiment, the present disclosure provides a permanent magnet material, wherein the rare earth element is selected from the group consisting of Nd, Sm, Pr, Dy, La, Ce, Gd, Tb, Ho, Er, Eu, Tm, Yb, Lu, Y, Sc, rare earth metal mixtures, and any combination thereof. Preferably, the rare earth element is Nd and/or Sm.

In a preferred embodiment, the present disclosure provides a permanent magnet material, wherein the transition metal element is selected from the group consisting of Fe, Co, Ni, Ti, Zr, Hf, V, Nd, Ta, Cr, Mo, W, Mn, Cu, Zn, Cd, and any combination thereof. Preferably, the transition metal element is one or more selected from Fe, Cu, Zr, and Co.

In a preferred embodiment, the present disclosure provides a permanent magnet material, comprising at least one hard magnetic phase and at least one soft magnetic phase, wherein the hard magnetic phase has a composition of $R_xT_y$, wherein R is selected from one or more rare earth elements, and T is selected from one or more transition metal elements, $0<x<5$, $0<y<30$. R is preferably Sm; T is preferably Co; T can also be one or more selected from Co, Fe, Cu, Zr.

In a preferred embodiment, the present disclosure provides a permanent magnet material, further comprising a hard magnetic phase having a composition of $R'_{x'}T'_{y'}M_{z'}$, wherein R' is selected from one or more rare earth elements, T' is selected from one or more transition metal elements, M is selected from one or more elements of Groups IIIA, IVA, VA, $0<x'<5$, $0<y'<30$, $0<z'<25$. R' is preferably Nd; T' is preferably Fe.

In a preferred embodiment, the present disclosure provides a permanent magnet material, comprising at least one hard magnetic phase and at least one soft magnetic phase wherein the hard magnetic phase having a composition of $R'_{x'}T'_{y'}M_{z'}$, wherein R' is selected from one or more rare earth elements, T' is selected from one or more transition metal elements, M is selected from one or more elements of Groups IIIA, IVA, VA, $0<x'<5$, $0<y'<30$, $0<z'<25$. R' is preferably Nd; T' is preferably Fe.

In a preferred embodiment, the present disclosure provides a permanent magnet material, wherein M is selected from the group consisting of B, Al, Ga, In, Tl, C, Si, Ge, Sn, Sb, Bi, and any combination thereof. M is preferably B.

In a preferred embodiment, the present disclosure provides a permanent magnet material comprising $R_xT_y$ and $R'_{x'}T'_{y'}M_{z'}$, wherein $R_xT_y$ and $R'_{x'}T'_{y'}M_{z'}$ are in a mass ratio of preferably 5-10:1, more preferably 8-10:1.

In a preferred embodiment, the present disclosure provides a permanent magnet material, wherein the at least one hard magnetic phase having a composition of $R_xT_y$ has an atomic ratio R:T of 1:4-10.

In a preferred embodiment, the present disclosure provides a permanent magnet material, wherein the at least one hard magnetic phase having a composition of $R_xT_y$ has an atomic ratio R:T of 1:4.5-5.5, 1:6.5-7.5, or 1:8-9.

In a preferred embodiment, the present disclosure provides a permanent magnet material, wherein the at least one hard magnetic phase having a composition of $R_xT_y$ has an atomic ratio R:T of 1:5, 1:7, or 2:17.

In a preferred embodiment, the present disclosure provides a permanent magnet material, wherein the at least one hard magnetic phase having a composition of $R_xT_y$ is selected from $PrCo_5$, $SmCo_5$, $SmCo_7$, $Sm_2Co_{17}$, $Sm_x(Co_{1-a-b-c}Fe_aCu_bZr_c)_y$ and any combination thereof, wherein a, b and c are each independently greater than or equal to 0, and less than 1, and 1-a-b-c>0.

In a preferred embodiment, the present disclosure provides a permanent magnet material, wherein said $Sm_x(Co_{1-a-b-c}Fe_aCu_bZr_c)_y$ has an atomic ratio Sm:Co:Fe:Cu:Zr in of 0.8-1.2:5-5.5:1-1.5:0.2-0.6:0.1-0.2.

In a preferred embodiment, the present disclosure provides a permanent magnet material, wherein said $Sm_x(Co_{1-a-b-c}Fe_aCu_bZr_c)_y$ has an atomic ratio Sm:Co:Fe:Cu:Zr in of 1.0:5.3:1.3:0.4:0.1.

In a preferred embodiment, the present disclosure provides a permanent magnet material, wherein the at least one $R'_{x'}T'_{y'}M_{z'}$ has an atomic ratio R':T':M of 1-3:13-15:0.5-2.

In a preferred embodiment, the present disclosure provides a permanent magnet material, wherein the at least one $R'_{x'}T'_{y'}M_{z'}$ has an atomic ratio R':T':M of 2:14:1.

In a preferred embodiment, the present disclosure provides a permanent magnet material, wherein the at least one $R'_{x'}T'_{y'}M_{z'}$ is selected from $Nd_2Fe_{14}B$, $Pr_2Fe_{14}B$, and any combination thereof.

In a preferred embodiment, the present disclosure provides a permanent magnet material, wherein the at least one soft magnetic phase comprises a soft magnet material.

In a preferred embodiment, the present disclosure provides a permanent magnet material, wherein the soft magnet material is selected from the group consisting of an elemental substance containing iron element, cobalt element or nickel element, an alloy containing iron element, cobalt element and/or nickel element, a compound containing iron element, cobalt element and/or nickel element, and any combination thereof.

In a preferred embodiment, the present disclosure provides a permanent magnet material, wherein the soft magnet material is α-Fe, Co, α-FeCo alloy, and any combination thereof.

In a preferred embodiment, the present disclosure provides a permanent magnet material, wherein the soft magnet material comprises Fe element and Co element in a mass ratio of 65-70:30-35.

In a preferred embodiment, the present disclosure provides a permanent magnet material, which is a composite permanent magnet material.

In a preferred embodiment, the present disclosure provides a permanent magnet material, which is a nanocomposite permanent magnet material.

In a preferred embodiment, the present disclosure provides a permanent magnet material, which does not contain a rare earth-rich phase.

In a preferred embodiment, the present disclosure provides a permanent magnet material, wherein at least a portion of the hard magnetic phase has grains with a preferential orientation in an easy magnetization direction.

In a preferred embodiment, the present disclosure provides a permanent magnet material, wherein the easy magnetization direction is the 001 or 002 direction of the crystal orientation index.

In a preferred embodiment, the present disclosure provides a permanent magnet material, wherein at least a portion of the hard magnetic phase has columnar crystals, and the columnar crystals have a preferential orientation along the long axis of the columnar crystals.

In a preferred embodiment, the present disclosure provides a permanent magnet material, wherein the at least one hard magnetic phase has a 002 diffraction peak with a relative intensity of greater than 40% in the XRD diffraction pattern of the method.

In a preferred embodiment, the present disclosure provides a permanent magnet material, having diffraction peaks of $SmCo_7$ phase in the XRD pattern, wherein $SmCo_7$ has diffraction peaks at one or more of the following 2θ angles: 30.5, 36.9, 42.9, 43.3, 44.3 and 48.7 degree.

Preferably, $SmCo_7$ has diffraction peaks at the following 2θ angles: 30.5, 36.9, 43.3, 44.3 and 48.7 degree.

Preferably, the diffraction peaks at 2θ angles of 30.5, 36.9, 42.9, 43.3, 44.3, 48.7 degree correspond to the diffraction peaks of planes (101), (110), (200), (111), (002), (201) of $SmCo_7$ phase respectively.

In a preferred embodiment, the present disclosure provides a permanent magnet material, wherein the diffraction peak of the plane (002) has a relative intensity of greater than 50%, preferably greater than 70%, more preferably 100%.

In a preferred embodiment, the present disclosure provides a permanent magnet material, having at least one XRD diffraction pattern selected from those shown in FIG. 5*a*, FIG. 5*b*, FIG. 15*a*, FIG. 15*b*, FIG. 18*a* or FIG. 18*b*.

In a preferred embodiment, the present disclosure provides a permanent magnet material, wherein the soft magnetic phase is distributed in a matrix of the hard magnetic phase.

In a preferred embodiment, the present disclosure provides a permanent magnet material, wherein the hard magnetic phase is distributed in a matrix of the soft magnetic phase.

In a preferred embodiment, the present disclosure provides a permanent magnet material, wherein at least a portion of the hard magnetic phase has particles (or grains) with a size of 50 nm or less, preferably 30 nm or less, more preferably 10-30 nm.

In a preferred embodiment, the present disclosure provides a permanent magnet material, wherein at least a portion of the soft magnetic phase has particles (or grains) with a size of 50 nm or less, preferably 30 nm or less, more preferably 10-20 nm.

In a preferred embodiment, the present disclosure provides a permanent magnet material, wherein at least a portion of the hard magnetic phase has rod-shaped the particles (or grains), and the rod-shaped particles (or grains) has a long axis size of 20-30 nm, and a short axis size of 5-10 nm.

In a preferred embodiment, the present disclosure provides a permanent magnet material, wherein magnetic exchange couple interaction exists at least a portion of an interface of the hard magnetic phase and the soft magnetic phase.

In a preferred embodiment, the present disclosure provides a permanent magnet material, wherein the content of the soft magnetic phase is 10-30 wt %, preferably 15-25 wt %, more preferably 20-25 wt %, still more preferably 22-24 wt %.

In a preferred embodiment, the present disclosure provides a permanent magnet material, having a size of a mm×b mm or more, wherein a is 0.5-3, preferably 1-2, b is 0.5-20, preferably 1-20, more preferably 5-15.

In an embodiment, the present disclosure provides a method for preparing a permanent magnet material, which comprises subjecting a hot press unit to hot press deformation, wherein the hot press unit consist of a permanent magnet blank and a mold in which the permanent magnet blank is placed; during the hot press deformation, the hot press unit is subjected to cooling treatment at both ends along the hot press pressure direction of the hot press.

In an embodiment, the present disclosure provides a method for preparing a permanent magnet material, which comprises, during the hot press deformation, heating the hot press unit prior to deformation of the hot press unit, while cooling both ends of the hot press unit in a certain cooling rate, so that the temperature of the middle part of the hot press unit reaches a hot deformation temperature and both ends of the hot press unit has a temperature lower than the hot deformation temperature;

preferably, the hot deformation temperature is 400-900° C.;

preferably, the temperature at both ends of the hot press unit is 300-600° C., preferably 300-500° C., more preferably 350-450° C. lower than the hot deformation temperature;

preferably, the temperature at both ends of the hot press unit is 100-400° C., preferably 150-350° C., more preferably 200-300° C.

In an embodiment, the present disclosure provides a method for preparing a permanent magnet material, wherein the cooling treatment is maintained during the hot press deformation.

In an embodiment, the present disclosure provides a method for preparing a permanent magnet material, wherein the maximum hot press pressure applied during the deformation of the hot press unit is 15-25 tons, preferably 18-22 tons, more preferably 20-21 tons.

In a preferred embodiment, the present disclosure provides a method for preparing a permanent magnet material, wherein during the deformation of the hot press unit, the middle part of the hot press unit reaches the hot deformation temperature that is 500-800° C., preferably 500-700° C., more preferably 600-700° C.

In a preferred embodiment, the present disclosure provides a method for preparing a permanent magnet material, wherein during the deformation of the hot press unit, the pressure-rising time is 5-80 s, preferably 15-60 s, more preferably 20-40 s.

In a preferred embodiment, the present disclosure provides a method for preparing a permanent magnet material, wherein during the hot press deformation, after the hot press pressure reaches the maximum pressure, the temperature and pressure are preserved for 1-60 s, preferably 20-40 s;

the pressure is preserved to be preferably 15-25 tons, more preferably 18-22 tons, the pressure may also be substantially the same as the maximum hot press pressure.

In a preferred embodiment, the present disclosure provides a method for preparing a permanent magnet material, wherein the hot press unit after the hot press deformation has a deformation in a direction parallel to the hot press pressure direction of 60-90%, preferably 65-85%, more preferably 70-80%.

In a preferred embodiment, the present disclosure provides a method for preparing a permanent magnet material, wherein the permanent magnet blank has a density of 4-10 g/cm$^3$, preferably 5-8 g/cm$^3$, more preferably 6-7.2 g/cm$^3$.

In a preferred embodiment, the present disclosure provides a method for preparing a permanent magnet material, wherein the mold is a cylindrical body has two open ends, and has an outer wall with a generatrix that is a concave curve, a straight line or a convex curve.

In a preferred embodiment, the present disclosure provides a method for preparing a permanent magnet material, wherein the concave curve or convex curve is an arc or a parabola.

In a preferred embodiment, the present disclosure provides a method for preparing a permanent magnet material, wherein the mold has a straight inner wall.

In a preferred embodiment, the present disclosure provides a method for preparing a permanent magnet material, wherein the mold has a height of 6-10 mm, preferably 7-8 mm.

In a preferred embodiment, the present disclosure provides a method for preparing a permanent magnet material, wherein the mold has an inner diameter of 5-8 mm, preferably 6-7 mm.

In a preferred embodiment, the present disclosure provides a method for preparing a permanent magnet material, wherein the mold has an outer diameter of 6-10 mm, for example, 7-8 mm or 8-9 mm; preferably has a maximum outer diameter of 8-9 mm, and preferably has a minimum outer diameter of 7-8 mm.

Preferably, the maximum outer diameter differs from the minimum outer diameter by 0-1 mm, for example 0.4-0.6 mm.

In a preferred embodiment, the present disclosure provides a method for preparing a permanent magnet material, wherein the mold is made of a metal, preferably a superalloy, more preferably GH4169 or GH2025 high temperature alloy steel.

In a preferred embodiment, the present disclosure provides a method for preparing a permanent magnet material, wherein the permanent magnet blank is formed by pressing a permanent magnet powder and a soft magnet powder.

In a preferred embodiment, the present disclosure provides a method for preparing a permanent magnet material, wherein the permanent magnet powder comprises at least one compound having a composition of $R_xT_y$, wherein R is selected from one or more rare earth elements, and T is selected from one or more transition metal elements.

In a preferred embodiment, the present disclosure provides a method for preparing a permanent magnet material, wherein the permanent magnet powder further comprises at least one compound having a composition of $R'_{x'}T'_{y'}M_{z'}$, wherein R' is selected from one or more rare earth elements, T' is selected from one or more transition metal elements, M is selected from one or more elements of Groups IIIA, IVA, VA and any combination thereof, $0<x'<5$, $0<y'<30$, $0<z'<25$.

In a preferred embodiment, the present disclosure provides a method for preparing a permanent magnet material, wherein the permanent magnet powder comprises at least one compound having a composition of $R'_{x'}T'_{y'}M_{z'}$, wherein R' is selected from one or more rare earth elements, T' is selected from one or more transition metal elements, M is selected from one or more elements of Groups IIIA, IVA, VA and any combination thereof, $0<x'<5$, $0<y'<30$, $0<z'<25$.

In a preferred embodiment, the present disclosure provides a method for preparing a permanent magnet material, wherein the soft magnet powder is selected from the group consisting of an elemental substance containing iron element, cobalt element or nickel element, a compound containing iron element, cobalt element and/or nickel element, an alloy containing iron element, cobalt element and/or nickel element, and any combination thereof.

In a preferred embodiment, the present disclosure provides a method for preparing a permanent magnet material, wherein the permanent magnet powder has an atomic ratio Sm:Co=1:5-6.

In a preferred embodiment, the present disclosure provides a method for preparing a permanent magnet material, wherein the permanent magnet powder has an atomic ratio:

Sm:Co:Fe:Cu:Zr=0.8-1.2:5-5.5:1-1.5:0.1-0.5:0.1-0.3;

or Sm:Co=1:5;

or Sm:Co:Nd:Fe:B=8-10:40-50:1-3:10-15:1-3.

In a preferred embodiment, the present disclosure provides a method for preparing a permanent magnet material, wherein the hot press deformation of the hot press unit is performed using an electric spark sintering system or a thermal simulation tester.

In a preferred embodiment, the present disclosure provides a method for preparing a permanent magnet material, wherein both ends of the hot press unit are subjected to cooling treatment along the hot press pressure direction is performed by passing cooling water through two electrodes in the electric spark sintering system or the thermal simulation tester.

In a preferred embodiment, the present disclosure provides a method for preparing a permanent magnet material, comprising one or more of the following steps:

1) mixing a permanent magnet powder and a soft magnet powder;

2) molding a mixture of the permanent magnet powder and the soft magnet powder into a permanent magnet blank;

3) placing the permanent magnet blank in a mold to obtain a hot press unit;

4) subjecting the hot press unit to hot press deformation;

5) subjecting the hot press unit after hot press deformation to stress relief treatment.

In a preferred embodiment, the present disclosure provides a method for preparing a permanent magnet material, wherein the mixing in step 1) is performed by ball-milling.

In a preferred embodiment, the present disclosure provides a method for preparing a permanent magnet material, wherein a ball-to-powder ratio in the ball-milling is 1:10-30, such as 1:20.

In a preferred embodiment, the present disclosure provides a method for preparing a permanent magnet material, wherein the time of the ball-milling is performed by 2-7 hr, preferably 4-5 hr.

In a preferred embodiment, the present disclosure provides a method for preparing a permanent magnet material, wherein the permanent magnet powder is amorphous after the ball-milling.

In a preferred embodiment, the present disclosure provides a method for preparing a permanent magnet material, wherein the permanent magnet material is a permanent magnet material in the aforementioned embodiments of the present disclosure.

In an embodiment, the present disclosure provides a permanent magnet material, which is prepared by a method in the aforementioned embodiments of the present disclosure.

The technical solutions of the present disclosure are further described in detail below with reference to the accompanying figures and examples. The illustrative examples of the present disclosure and their descriptions are used to explain the present disclosure and are not intended to limit the present disclosure.

SPECIFIC EXAMPLES

Unless otherwise specified, the magnetic property parameters involved in the examples of the present disclosure included intrinsic coercivity $H_{in}$ (unit: kOe), saturation magnetization 4πMs (unit: kGs), maximum energy product $(BH)_{max}$ (unit: MGOe), remanent magnetization 4πMr (unit: kGs) and remanence ratio Mr/Ms.

The hot press deformation parameters involved in the examples of the present disclosure included hot deformation temperature T1 (° C.), temperature at both ends T2 (° C.), maximum hot press pressure F (ton), pressure-rising time t1(s), heat and pressure preservation time t2 (s), deformation e %.

The brands and models of various test devices used in the examples are given as follows:

| Test devices | Device brand | Device model |
|---|---|---|
| XRD | Rigaku | D/Max-2500/PC |
| TEM | Japan Electronics | JEM2010 |
| SPS | SPS SYNTEX INC., Japan | SPS-3.2MK-IV |
| Thermal simulation tester | DSI Co., USA | Gleeble 3500 |
| VSM | Lakeshore, USA | 7407 |

Examples 1-9

1. Preparation of Precursor:

Raw materials included a permanent magnet powder and a soft magnet powder. Specifically, the permanent magnet powder was a mixture of SmCoFeCuZr alloy powder and $SmCo_5$ alloy powder (both powders were purchased from Alfa Aesar, USA). The weight ratio of various elements in the SmCoFeCuZr alloy powder was Sm:Co:Fe:Cu:Zr=25.5:52.5:14:5:3, and the weight ratio of various elements in the $SmCo_5$ alloy powder was Sm:Co=33:67. After the two powders were mixed, by conversion, the atomic ratio of various elements in the mixed powder was Sm:Co:Fe:Cu:Zr=1.0:5.3:1.3:0.4:0.1. The soft magnet powder included α-Fe powder and Co powder, wherein the weight ratio of α-Fe:Co was 70:30.

The raw materials of Examples 1-9 respectively included different amounts of the soft magnet powder, and the mass fractions of the soft magnet powders in the raw materials of Examples 1-9 were shown in Table 1. In an argon-protected glove box, the permanent magnet powder and the soft magnet powder were put into a ball mill jar, the ball to powder ratio of 20:1, and ball-milled on a SPEX ball mill for 4.5 hours to obtain a precursor.

Figure 4:
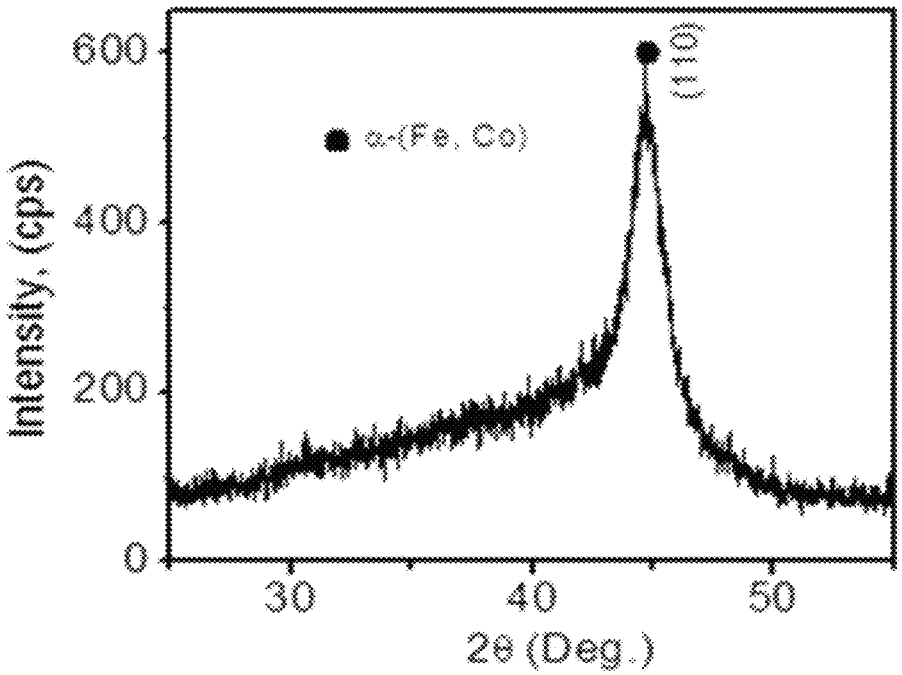
FIG. 4 is an XRD pattern of the precursor in Example 6.

The X-ray diffraction (XRD) pattern of the precursor was as shown in FIG. 4, which showed only the diffraction peak of the α-Fe (Co) phase and no other diffraction peaks, indicating that the permanent magnet phase after ball-milling was amorphous.

Figure 3:
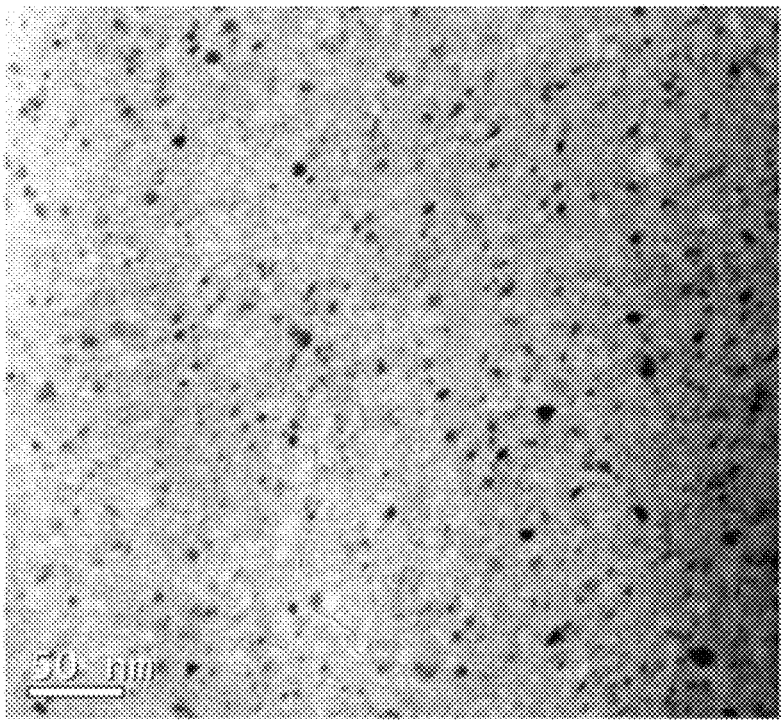
FIG. 3 is a TEM photograph of the precursor in Example 6.

The transmission electron microscopy (TEM) photograph of the precursor was as shown in FIG. 3, which showed a lot of uniformly dispersed grains, having a size of about 3~5 nm. By combining the XRD pattern of FIG. 4, it could be seen that the above grains were α-Fe (Co) soft magnet grains. These α-Fe (Co) soft magnet grains were uniformly distributed in the amorphous matrix formed by the permanent magnet powder.

2. Molding: the precursor obtained above by ball milling was molded at room temperature, to obtain a permanent magnet blank. The permanent magnet blank was a cylinder with a diameter of about 6 mm and a height of about 2 mm, which had a density of about 6.8-7.2 g/cm$^3$.

Four permanent magnet blanks obtained above were placed in a mold. As shown in FIG. 1, the mold of Examples 1-9 was a cylinder with two open ends, the inner wall of the cylinder was straight, the generatrix of the outer wall of the cylinder was a concave curve, and the lowest point of the curve was located at a ½ height of the cylinder. The cylinder had a height h=8 mm, an inner diameter $d_1$=6.2 mm, an outer diameter $d_3$=8 mm at both ends of the cylinder, and an outer diameter $d_2$=7.6 mm at middle part of the cylinder. The mold was made of GH4169 high temperature alloy steel. The above-mentioned permanent magnet blank and the mold in which the permanent magnet blank was placed together formed a hot press unit of the present disclosure.

3. Hot press deformation: the hot press unit obtained above was subjected to hot press deformation, the hot press deformation diagram being as shown in FIG. 2.

Figure 2:
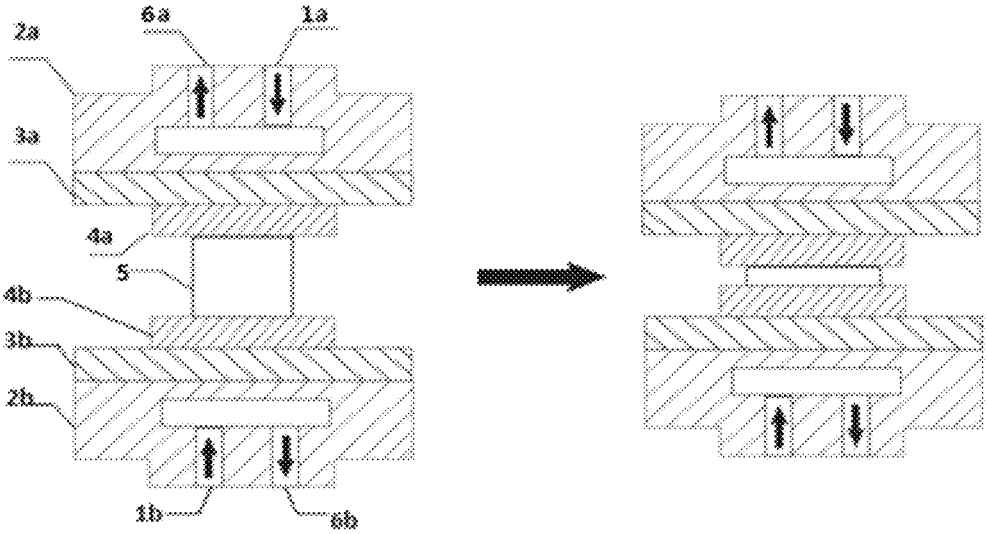
FIG. 2 is a schematic diagram of the hot press deformation process in Example 1-9.

As shown in FIG. 2, the hot press unit was subjected to hot press deformation using an electric spark sintering system (SPS for short). Graphite gaskets 3*a* and 3*b* were respectively placed on two electrodes 2*a* and 2*b* of the SPS system, carbide indenters 4*a* and 4*b* were further respectively placed on the graphite gaskets 3*a* and 3*b*, and the hot press unit 5 was placed between the two carbide indenters 4*a* and 4*b*, the axis of the hot press unit 5 being parallel to the pressure direction. In addition, cooling water inlets 1*a*, 1*b* and cooling water outlets 6*a*, 6*b* were provided at the two electrodes 2*a*, 2*b* of the SPS system. A thermocouple was provided at a ½ height of the outer wall of the hot press unit 5, and the temperature measured by the thermocouple was the temperature of the middle part of the hot press unit 5. Thermocouples were provided at the carbide indenters 4*a* and 4*b*, and the temperatures measured by the thermocouples were the temperatures at both ends of the hot press unit.

The hot press unit was subjected to hot press deformation using the SPS system. First, the hot press unit 5 was clamped between the two carbide indenters 4*a* and 4*b* and heated. At the same time, cooling water was charged at the two electrodes 2*a* and 2*b* of the SPS system so that the temperatures at both ends of the hot press unit 5 decreased. Under the double action of heating and cooling water treatment, a temperature gradient was formed in the hot press unit 5 with a high temperature at middle part and a low temperature at both ends in a direction parallel to the hot press pressure direction (i.e., the axial direction of the hot press unit). When the temperature of the middle part of the hot press unit 5 reached the hot deformation temperature T1 (° C.), and the temperature at both ends was T2 (° C.), the hot press unit had not begun to deform. While maintaining the temperature of the middle part of the hot press unit at T1, and maintaining the cooling water conditions, the hot press pressure was gradually increased to the maximum pressure F (ton) within a period of time which was defined as the pressure-rising time t1 (s). During the pressure-rising period, the hot press unit 5 was deformed. Then, the hot press unit 5 was preserved at the hot deformation temperature T1 and the maximum hot press pressure F for t2 (s), then the temperature and the pressure were removed, to complete the hot press deformation. After the above hot press deformation, the deformation of the hot press unit in the hot press pressure direction was ε%.

4. Stress relief treatment: The hot press unit 5, after the above hot press deformation, was subjected to heat treatment at 100° C. for 36 hours to obtain the permanent magnet materials of Examples 1-9, with a diameter of about 13 mm, and a height of about 1.7 mm.

Table 1 showed the weight contents of the soft magnet powder in the raw materials, the atomic percentages of rare earth elements in the permanent magnet material, and various hot press deformation parameters as well as various magnetic property parameters of the permanent magnet material in Examples 1-9.

TABLE 1

| Example No. | 1 | 2 | 3 | 4 | 5 | 6 | 7 | 8 | 9 |
|---|---|---|---|---|---|---|---|---|---|
| Soft magnet powder content (wt %) | 5% | 10% | 15% | 20% | 22% | 23% | 24% | 25% | 30% |
| Rare earth element content (atomic %) | 11.1% | 9.9% | 8.9% | 7.9% | 7.6% | 7.4% | 7.3% | 7.1% | 6.3% |
| Magnetic property parameters | | | | | | | | | |
| Intrinsic coercivity | 9.1 | 6.9 | 5.7 | 5.3 | 4.6 | 4.5 | 4.6 | 4.0 | 2.8 |
| Saturation magnetization | 10.4 | 11.5 | 12.4 | 13.1 | 13.6 | 13.8 | 13.8 | 14.2 | 15.0 |
| Maximum energy product | 18.5 | 22.2 | 23.4 | 24.7 | 26.5 | 27.3 | 25.5 | 24.5 | 21.5 |
| Remanent magnetization | 9.6 | 10.3 | 11.1 | 11.8 | 12.4 | 12.7 | 12.5 | 12.8 | 13.5 |
| Remanence ratio | 0.882 | 0.899 | 0.900 | 0.903 | 0.911 | 0.92 | 0.906 | 0.905 | 0.903 |

Other hot press deformation parameters

| Hot deformation temperature T1 | Temperature T2 at both ends | Maximum hot press pressure F | Pressure-rising time t1 | Heat and pressure preservation time t2 | Deformation ε % |
|---|---|---|---|---|---|
| 620° C. | 220° C. | 20 tons | 30 s | 60 s | 79% |

Figure 8:
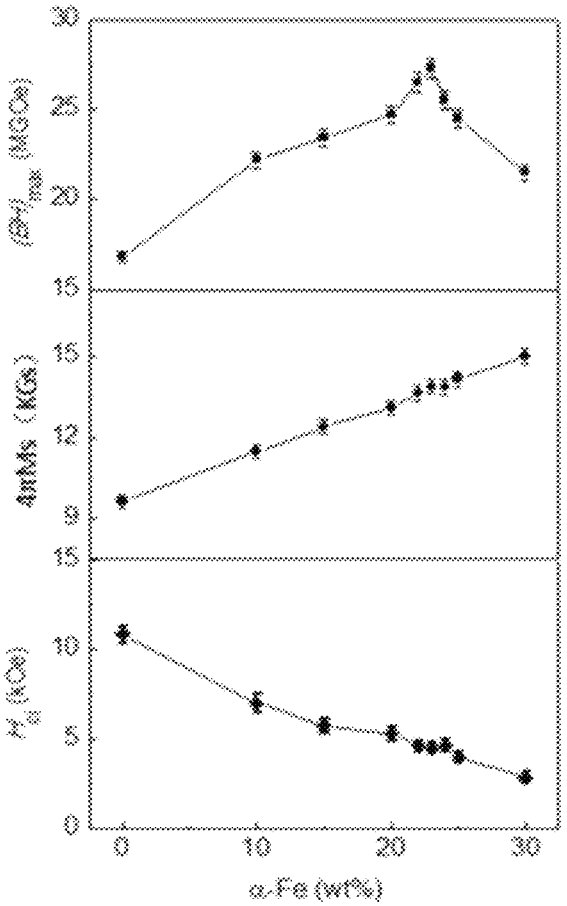
FIG. 8 shows curves of relation between intrinsic coercivity, saturation magnetization and maximum energy product of the permanent magnet materials in Example 1-9 and the content of the soft magnet powder.

FIG. 8 showed the variation of various magnetic property parameters of the permanent magnet materials of Examples 1-9 as a function of the mass percentage of the soft magnet powder in the raw materials.

Figure 5:
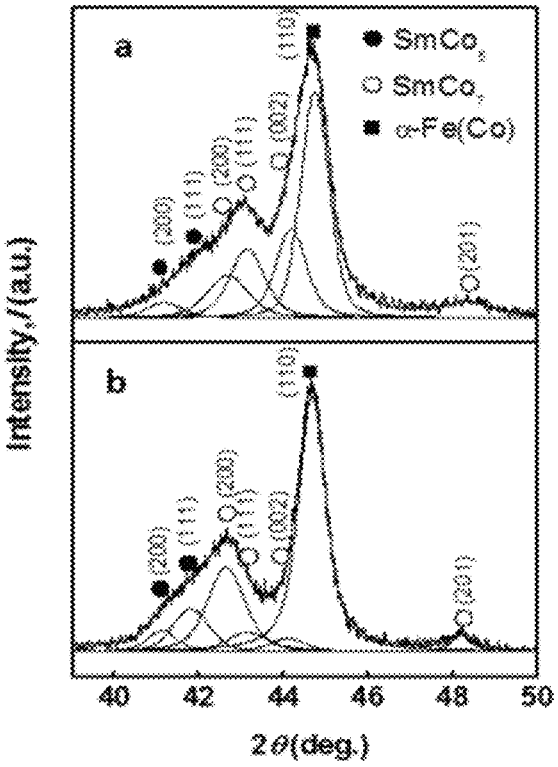
FIG. 5 is an XRD pattern of the permanent magnet material in Example 6.

For the permanent magnet material of Example 6, the XRD patterns of its two faces perpendicular to (FIG. 5*a*) and parallel to (FIG. 5*b*) the hot press pressure direction were as shown in FIG. 5. Qualitative analysis showed that, after deformation, the permanent magnet material included three phases, i.e., $SmCo_7$, $SmCo_5$ and α-Fe (Co) phases. According to the XRD pattern, there was no obvious Fe, Cu, Zr phase. The comparison between FIG. 5*a* and FIG. 5*b* showed that the relative intensities of various diffraction peaks were obviously different, especially the relative intensities of various diffraction peaks of the $SmCo_7$ phase were obviously different. FIG. 5*a* showed the XRD curve of the face perpendicular to the hot press pressure direction, with the (002) diffraction peak of the $SmCo_7$ phase being the strongest peak (see the peak fitting data). On the PDF standard card, the strongest peak of the $SmCo_7$ phase was the (111) peak, and the relative intensity of the (002) peak was only 30% compared to the strongest peak. It could be seen that the relative intensity of the (002) diffraction peak of the $SmCo_7$ phase in the permanent magnet material of this example was higher than that of the standard card. FIG. 5*b* showed the XRD curve of the face parallel to the hot press pressure direction, with the (200) diffraction peak of the $SmCo_7$ phase being the strongest peak, the (002) diffraction peak being obviously lower than other diffraction peaks, and the plane (200) being perpendicular to the plane (002). The above data demonstrated that the $SmCo_7$ phase of the permanent magnet material had a texture of [001] direction in the hot press pressure direction.

Figure 6:
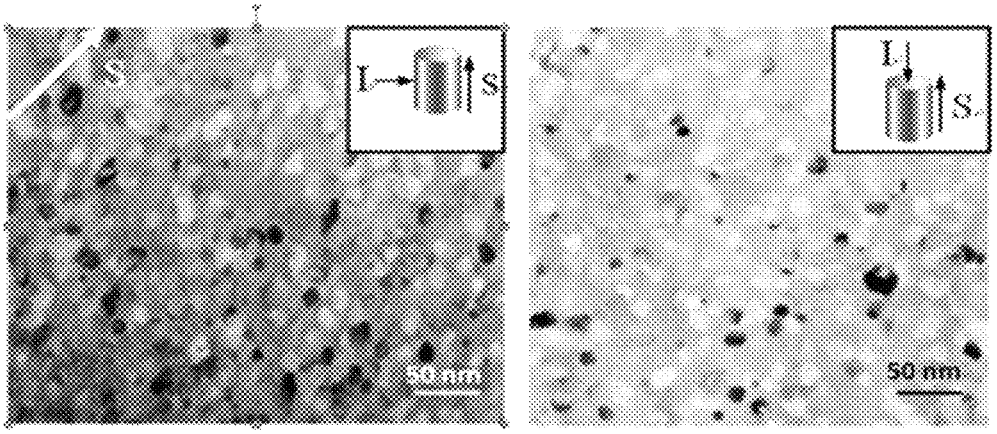
FIG. 6 is a TEM photograph of the permanent magnet material in Example 6.

For the permanent magnet material of Example 6, the TEM photographs of its two faces parallel to (FIG. 6*a*) and perpendicular to (FIG. 6*b*) the hot press pressure direction were as shown in FIG. 6. In the block diagrams at the upper right corner of FIGS. 6*a* and 6*b*, the hot press pressure direction was indicated by an arrow S, and the photoing direction was indicated by an arrow 1. As shown in FIG. 6*a*, a part of the grains were rod-shaped, and the long axis direction of the rod was parallel to the hot press pressure direction (the direction of the arrow S at the upper right corner). The rod-like grains had a long axis size of about 20-30 nm and a short axis size of about 10 nm. By combining the results of XRD analysis, it could be seen that these rod-shaped grains were $SmCo_7$ grains with a preferential orientation, and the long axis direction of the rod was the easy magnetization direction of $SmCo_7$. The spherical grains around the rod-shaped grains were grains of $SmCo_5$ and α-Fe (Co) phases, with a size of about 10-20 nm. The above XRD and TEM indicated that the composite permanent magnet had structural anisotropy.

Figure 7:
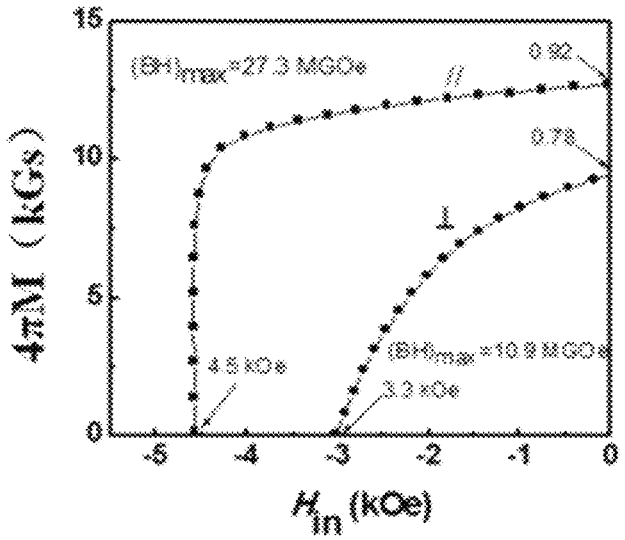
FIG. 7 is a demagnetization curve of the permanent magnet material in Example 6.

For the permanent magnet material of Example 6, its demagnetization curves in directions parallel to (denoted by //) and perpendicular to (denoted by ⊥) the hot press pressure direction were as shown in FIG. 7. The maximum energy products of the material in directions parallel to and perpendicular to the hot press pressure direction were 27.3 MGOe and 10.9 MGOe respectively; the intrinsic coercivities were 4.5 kOe and 3.3 kOe respectively; the remanence ratios were 0.92 and 0.78 respectively; and the magnetic properties of the material in a direction parallel to the hot press pressure direction were obviously superior to the magnetic properties of the material in a direction perpendicular to the hot press pressure direction. The direction parallel to the hot press pressure direction was the easy magnetization direction of the permanent magnet material, and the magnetic performance in this direction was better; while the direction perpendicular to the hot press pressure direction was the hard magnetization direction of the permanent magnet material, and the magnetic performance in this direction was worse. The above results demonstrated that the permanent magnet material had magnetic anisotropy. The magnetic properties were in good agreement with the above results of XRD and TEM analyses, which further demonstrated that the easy magnetization axis (i.e. [001] direction) of the $SmCo_7$ phase had a preferential orientation parallel to the hot press pressure direction, i.e., the permanent magnet material had a texture along the orientation index [001] direction.

By combining the above analyses, it could be seen that the permanent magnet material of the present disclosure had obvious structural anisotropy and magnetic anisotropy.

Examples 10-14

The raw materials were the same as those in Example 6, wherein the mass fraction of the soft magnet powder was 23 wt %, and the corresponding atomic percentage of the rare earth elements was 7.4%.

Table 2 showed the hot deformation temperature T1, the temperature T2 at both ends, and other hot press deformation parameters, as well as various magnetic property parameters of the permanent magnet material in a direction parallel to the hot press pressure direction in Examples 10-14. Please refer to Examples 1-9 with respect to other hot press deformation steps and parameters than the hot press deformation parameters defined in Table 2.

TABLE 2

| | Example | | | | |
|---|---|---|---|---|---|
| | 10 | 11 | 12 | 13 | 14 |
| Hot deformation temperature T1 | 500° C. | 550° C. | 600° C. | 630° C. | 650° C. |
| Temperature T2 at both ends | 150° C. | 170° C. | 200° C. | 220° C. | 240° C. |
| Magnetic property parameters | | | | | |
| Intrinsic coercivity | 3.3 | 3.8 | 4.2 | 4.50 | 4.6 |
| Saturation magnetization | 13.9 | 13.9 | 13.8 | 13.8 | 13.7 |
| Maximum energy product | 19.5 | 23.8 | 25.1 | 26.1 | 22.7 |

| Other hot press deformation parameters | | | |
|---|---|---|---|
| Pressure-rising time t1 | Heat and pressure preservation time t2 | Deformation ε% | Maximum hot press pressure F |
| 30 s | 60 s | 79% | 20 tons |

Examples 15-20

The raw materials were the same as those in Example 6, wherein the mass fraction of the soft magnet powder was 23 wt %, and the corresponding atomic percentage of the rare earth elements was 7.4%.

Table 3 showed the pressure-rising time t1 (s), and other hot press deformation parameters, as well as various magnetic property parameters of the permanent magnet material in a direction parallel to the hot press pressure direction in Examples 15-20. Please refer to Examples 1-9 with respect to other hot press deformation steps and parameters than the hot press deformation parameters defined in Table 3.

TABLE 3

| | Example | | | | | |
|---|---|---|---|---|---|---|
| | 15 | 16 | 17 | 18 | 19 | 20 |
| Pressure-rising time t1 (s) | 15 s | 22 s | 27 s | 32 s | 40 s | 60 s |
| Magnetic property parameters | | | | | | |
| Intrinsic coercivity | 3.3 | 3.9 | 3.9 | 4.4 | 4.7 | 4.9 |
| Saturation magnetization | 14.0 | 14.0 | 13.9 | 13.9 | 13.8 | 13.7 |

TABLE 3-continued

| | | | | | | |
|---|---|---|---|---|---|---|
| Maximum energy product | 19.5 | 20.6 | 22.7 | 25.3 | 22.5 | 20.4 |

| Other hot press deformation parameters | |
|---|---|
| Hot deformation temperature T1 | Temperature T2 at both ends |
| 680° C. | 250° C. |

TABLE 3-continued

| Maximum hot press pressure F | Heat and pressure preservation time t2 | Deformation ε% |
|---|---|---|
| 20 tons | 60 s | 79~81% |

Examples 21-25

The raw materials were the same as those in Example 6, wherein the mass fraction of the soft magnet powder was 23 wt %, and the corresponding atomic percentage of the rare earth elements was 7.4%.

Table 4 showed the profile parameters of the hot pressure mold, and other hot press deformation parameters, as well as various magnetic property parameters of the permanent magnet material in a direction parallel to the hot press pressure direction in Examples 21-25. Please refer to Examples 1-9 with respect to other hot press deformation steps and parameters than the hot press deformation parameters defined in Table 4. The height of the permanent magnet blank was 2 mm, and its diameter was basically the same as the inner diameter of the hot pressure mold used.

Figure 9:
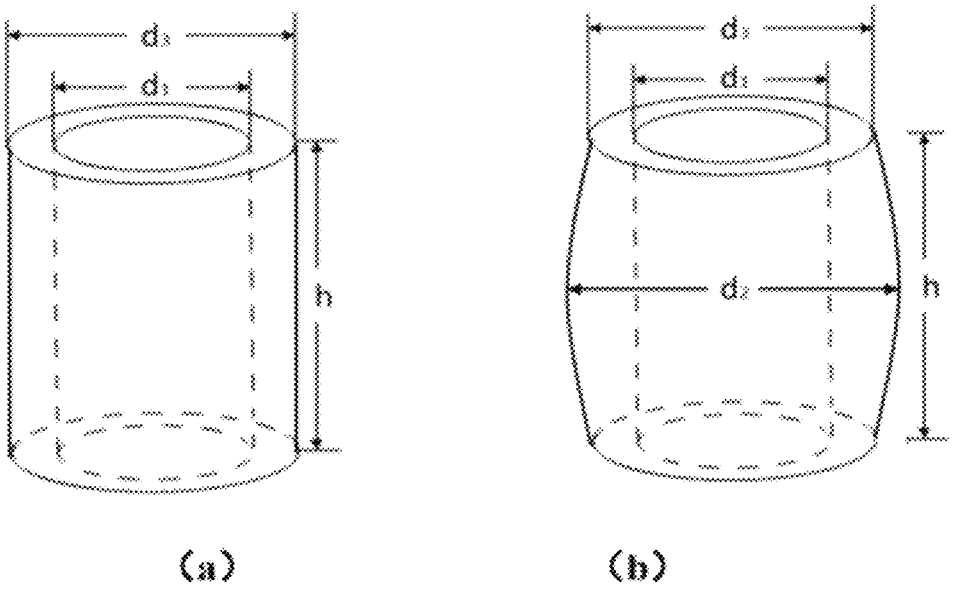
FIG. 9 is a schematic diagram of the mold in Examples 21-25.

FIG. 9 showed a mold with a straight outer wall and a mold with a convex outer wall. FIG. 9*a* showed a mold with a straight outer wall, which was a cylinder with two open ends, wherein the inner wall and the outer wall of the cylinder both were straight, the generatrix of the outer wall of the cylinder was a straight line perpendicular to the bottom face, and the cylinder had a height h, an inner diameter $d_1$ and an outer diameter $d_3$. FIG. 9*b* showed a mold with a convex outer wall, which was a cylinder with two open ends, wherein the inner wall of the cylinder was straight, the generatrix of the outer wall of the cylinder was a convex curve, and the highest point of the curve was located at a ½ height of the cylinder, and the cylinder had a height h, an inner diameter $d_1$, an outer diameter $d_3$ at both ends of the cylinder, and an outer diameter $d_2$ at middle part of the cylinder.

The hot pressure molds in Examples 21-25 were made of GH4169 high temperature alloy steel.

TABLE 4

| | Example | | | | |
|---|---|---|---|---|---|
| | 21 | 22 | 23 | 24 | 25 |
| Mold characteristics | Concave outer wall<br>h = 10 mm<br>d1 = 6 mm<br>d2 = 7.4 mm<br>d3 = 7.8 mm | Concave outer wall<br>h = 6 mm<br>d1 = 6 mm<br>d2 = 7.4 mm<br>d3 = 7.8 mm | Concave outer wall<br>h = 4 mm<br>d1 = 6 mm<br>d2 = 7.4 mm<br>d3 = 7.8 mm | Convex outer wall<br>h = 8 mm<br>d1 = 6 mm<br>d2 = 9 mm<br>d3 = 8.4 mm | Straight outer wall<br>h = 8 mm<br>d1 = 6 mm<br>d3 = 8 mm |
| Number of permanent magnet blanks | 5 | 3 | 2 | 4 | 4 |
| Magnetic property parameters | | | | | |
| Intrinsic coercivity | 5.2 | 4.6 | 4.8 | 4.8 | 4.7 |
| Saturation magnetization | 13.8 | 13.8 | 13.6 | 13.8 | 13.9 |
| Maximum energy product | 21.4 | 26.1 | 22.4 | 20.9 | 26.2 |
| Remanent magnetization | 12.1 | 12.5 | 12.1 | 12.0 | 12.6 |
| Remanence ratio | 0.872 | 0.906 | 0.895 | 0.869 | 0.904 |

| Other hot press deformation parameters | | | | | |
|---|---|---|---|---|---|
| Hot deformation temperature T1 | Temperature T2 at both ends | Maximum hot press pressure F | Pressure-rising time t1 | Heat and pressure preservation time t2 | Deformation ε% |
| 580° C. | 180° C. | 20 tons | 30 s | 60 s | 78~80% |

Examples 26 to 31

The raw materials were the same as those in Example 6, wherein the mass fraction of the soft magnet powder was 23 wt %, and the corresponding atomic percentage of the rare earth elements was 7.4%.

Table 5 showed the deformation (unit: %), and other hot press deformation parameters, as well as various magnetic property parameters of the permanent magnet material in a direction parallel to the hot press pressure direction in Examples 26-31. Please refer to Examples 1-9 with respect to other hot press deformation steps and parameters than the hot press deformation parameters defined in Table 5.

TABLE 5

| | Example | | | | | |
|---|---|---|---|---|---|---|
| | 26 | 27 | 28 | 29 | 30 | 31 |
| Deformation (%) | 65% | 70% | 73% | 77% | 80% | 83% |
| Magnetic property parameters | | | | | | |
| Intrinsic coercivity | 4.2 | 4.2 | 4.2 | 4.3 | 4.4 | 4.4 |
| Saturation magnetization | 13.7 | 13.7 | 13.8 | 13.8 | 13.9 | 13.9 |
| Maximum energy product | 19.1 | 21.0 | 22.1 | 24.8 | 26.5 | 27.0 |

TABLE 5-continued

| Other hot press deformation parameters | | |
|---|---|---|
| Hot deformation temperature T1 | Temperature T2 at both ends | |
| 620° C. | 210° C. | |
| Maximum hot press pressure F | Pressure-rising time t1 | Heat and pressure preservation time t2 |
| 20 tons | 30 s | 60 s |

Comparative Example 1

The precursor of Example 6 (the content of the soft magnet powder in the raw material was 23 wt %) was used, with the corresponding atomic percentage of the rare earth elements being 7.4%. A permanent magnet material was prepared using a cubic press.

Specifically, the above precursor was press molded to obtain a cylindrical permanent magnet body having a diameter of 6 mm and a height of 2-3 mm. The permanent magnet body was wrapped with a layer of aluminium foil having a thickness of 0.01 mm, then embedded in cubic boron nitride powder, and further molded to obtain a cylindrical hot press unit with a diameter of 10 mm and a height of 15 mm. The above hot press unit was placed in a graphite sheath having an inner diameter of 11 mm, an outer diameter of 14 mm and a height of 19.5 mm. The graphite sheath was placed in a pyrophyllite mold, which was a pyrophyllite block having a through hole of 14 mm in diameter and side lengths of 32 mm×32 mm×32 mm, with a steel gasket having a diameter of 14 mm and a height of 6 mm being placed on each end. The above whole device was hot pressed on a cubic press, while heating the hot press unit by electrifying the graphite sheath. The hot press pressure was 3 GPa, the temperature was 650° C., and the time was 60 s, so that the permanent magnet material of Comparative Example 1 was obtained. The pressure was isostatic pressure, and the permanent magnet material basically had no deformation.

Figure 10:
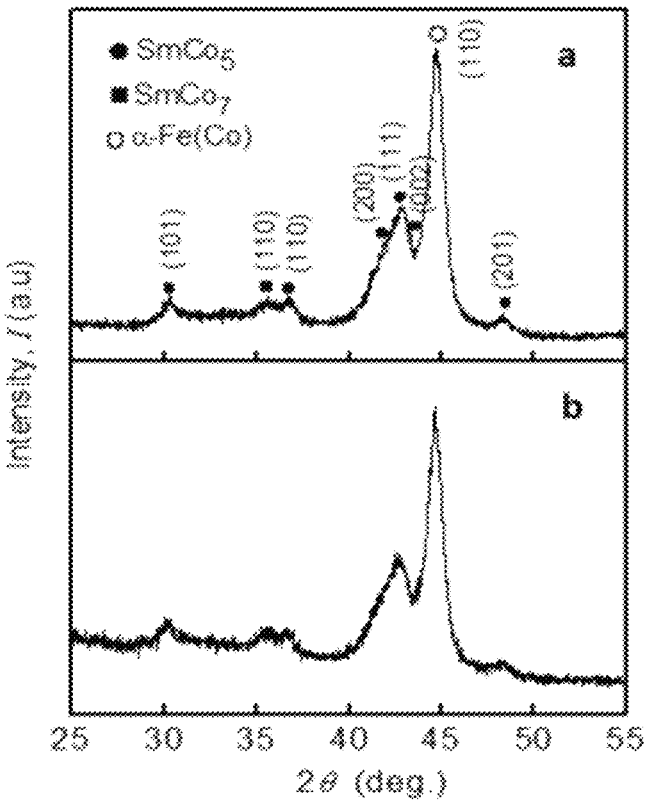
FIG. 10 is an XRD pattern of the permanent magnet material in Comparative Example 1.

FIG. 10 showed the XRD pattern of the permanent magnet material, in which FIG. 10*a* and FIG. 10*b* showed the XRD patterns of bottom face and side face of the cylindrical permanent magnet material respectively. In the two XRD patterns, the intensities of various peaks were basically the same, and no preferential orientation of grains was observed, i.e., the permanent magnet material had no crystal texture.

Figure 11:
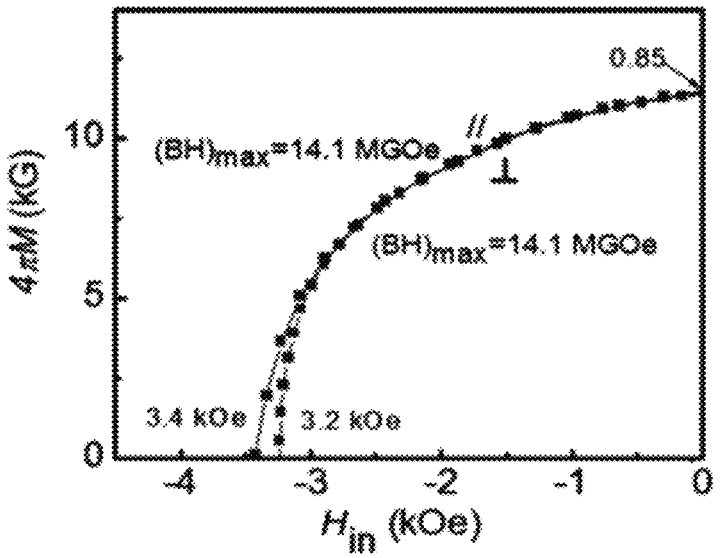
FIG. 11 is a demagnetization curve of the permanent magnet material in Comparative Example 1.

FIG. 11 showed demagnetization curves of the cylindrical permanent magnet material in directions parallel to the bottom face (denoted by //) and perpendicular to the bottom face (denoted by ⊥). The maximum energy product of the permanent magnet material was 14.1 MGOe, and the material was magnetically isotropic.

Examples 32-36

Raw materials included permanent magnet powder and soft magnet powder, wherein the permanent magnet powder was $SmCo_5$ powder (which was purchased from Alfa Aesar, USA), and the soft magnet powder was α-Fe powder. The mass fraction of the soft magnet powder in the raw material was adjusted according to Table 6. In an argon-protected glove box, the permanent magnet powder and the soft magnet powder were put into a ball mill jar, the ball to powder ratio of 20:1, and ball-milled on a SPEX ball mill for 4 hours to obtain a precursor.

Table 6 showed the weight contents of the soft magnet powder in the raw materials, the atomic percentages of rare earth elements in the permanent magnet material, and various hot press deformation parameters as well as various magnetic property parameters in Examples 32-36. Please refer to Example 6 with respect to other hot press deformation steps and parameters than the hot press deformation parameters defined in Table 6.

Figure 12:
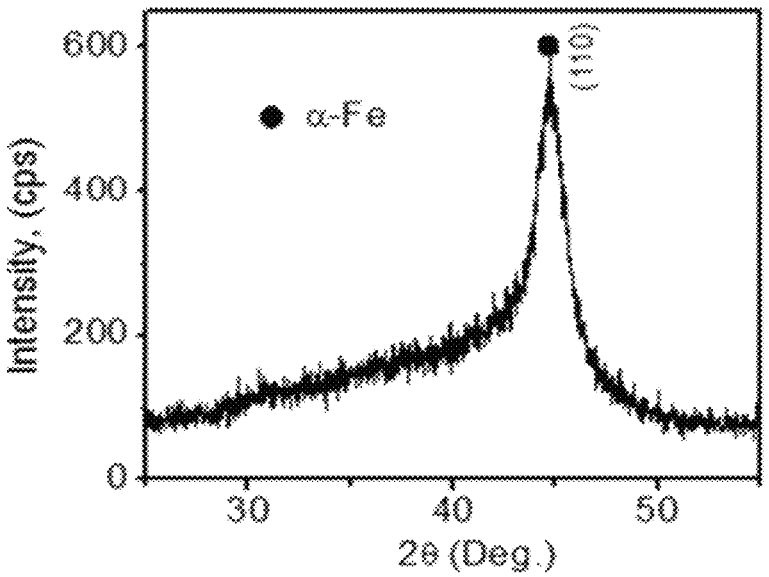
FIG. 12 is an XRD pattern of the precursor in Example 34.

The X-ray diffraction (XRD) pattern of the precursor in Example 34 was as shown in FIG. 12, which showed only the diffraction peak of the α-Fe phase and no other diffraction peaks, indicating that the permanent magnet powder in the precursor was still amorphous.

Figure 13:
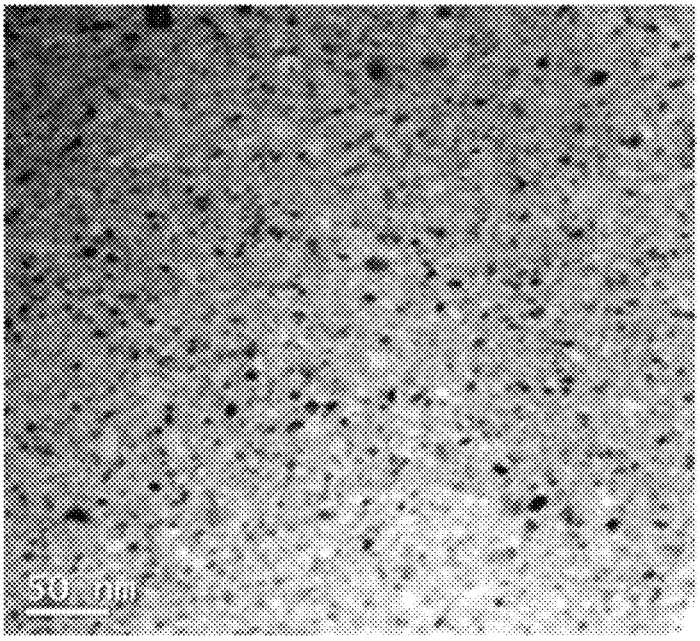
FIG. 13 is a TEM photograph of the precursor in Example 34.

The transmission electron microscopy (TEM) photograph of the precursor in Example 34 was as shown in FIG. 13, which showed a lot of uniformly dispersed grains, having a size of about 3~5 nm. By combining the XRD pattern of FIG. 12, it could be seen that the above grains were α-Fe soft magnet grains. These soft magnet grains were uniformly distributed on the $SmCo_5$ permanent magnet powder amorphous matrix.

Figure 15:
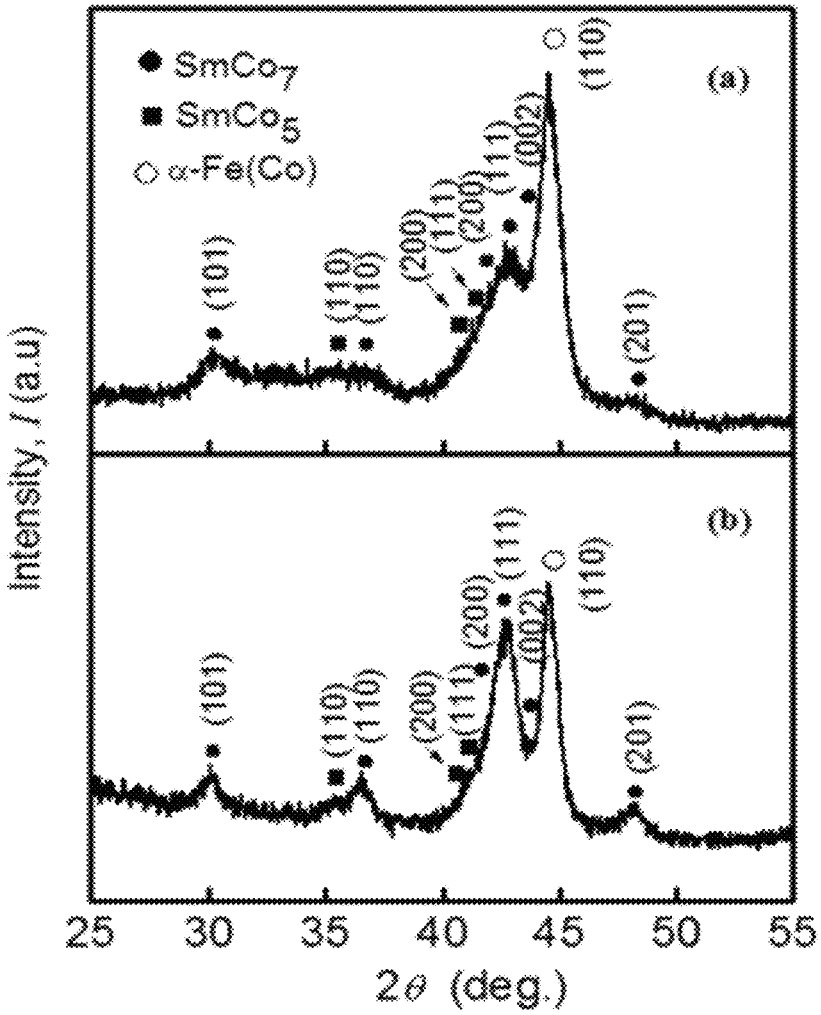
FIG. 15 is an XRD pattern of the permanent magnet material in Example 34.

The XRD patterns of two faces of the permanent magnet material in Example 34 perpendicular to (FIG. 15*a*) and parallel to (FIG. 15*b*) the hot press pressure direction were as shown in FIG. 15.

For the permanent magnet material of Example 34, after deformation, the permanent magnet material included three phases, i.e., $SmCo_7$, $SmCo_5$ and α-Fe (Co) phases. The comparison between FIG. 15*a* and FIG. 15*b* showed that the relative intensities of various diffraction peaks were obviously different, especially the relative intensities of various diffraction peaks of the $SmCo_7$ phase were obviously different. FIG. 15*a* showed the XRD curve of the face perpendicular to the hot press pressure direction, wherein the relative intensity of the (002) diffraction peak of the $SmCo_7$ phase was obviously higher than the relative intensity of the plane (002) parallel to the hot press pressure direction (see FIG. 15*b*). The above data demonstrated that the $SmCo_7$ phase of the permanent magnet material had a texture of [001] direction in the hot press pressure direction.

Figure 14:
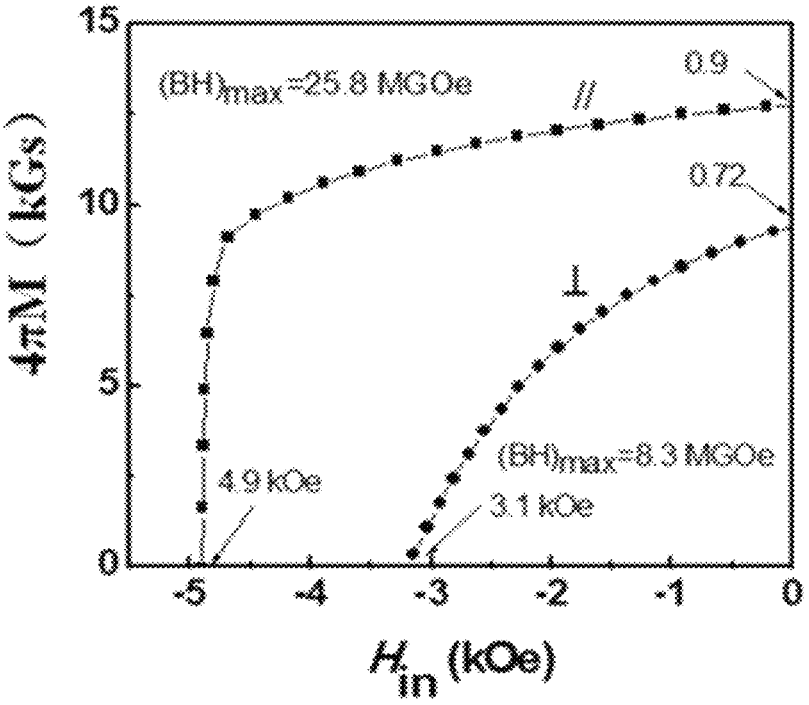
FIG. 14 is a demagnetization curve of the permanent magnet material in Example 34.

For the per magnet material of Example 34, its demagnetization curves in directions parallel to (denoted by //) and perpendicular to (denoted by ⊥) the hot press pressure direction were as shown in FIG. 14. The maximum energy products of the material in directions parallel to and perpendicular to the hot press pressure direction were 25.8 MGOe and 8.3 MGOe respectively; the intrinsic coercivities were 4.9 kOe and 3.1 kOe respectively; the remanence ratios were 0.9 and 0.72 respectively; and the magnetic properties of the material in a direction parallel to the hot press pressure direction were obviously superior to the magnetic properties of the material in a direction perpendicular to the hot press pressure direction. The direction parallel to the hot press pressure direction was the easy magnetization direction of the permanent magnet material, and the magnetic performance in this direction was better; While the direction perpendicular to the hot press pressure direction was the hard magnetization direction of the permanent magnet material, and the magnetic performance in this direction was worse. The above results demonstrated that the permanent magnet material had obvious magnetic anisotropy. The magnetic property parameters verified the above results of XRD and TEM analyses, i.e., the easy magnetization axis (i.e. [001] direction) of the $SmCo_7$ phase had a preferential orientation parallel to the hot press pressure direction, and the permanent magnet material had a texture along the orientation index [001] direction

TABLE 6

| | Example No. | | | | |
|---|---|---|---|---|---|
| | 32 | 33 | 34 | 35 | 36 |
| Soft magnet powder content (wt %) | 22% | 24% | 26% | 28% | 30% |
| Rare earth element content (atomic %) | 12.1% | 11.7% | 11.4% | 11.0% | 10.6% |
| Magnetic property parameters | | | | | |
| Intrinsic coercivity | 5.9 | 5.4 | 4.9 | 4.7 | 4.5 |
| Saturation magnetization | 13 | 13.6 | 14 | 14.5 | 14.7 |
| Maximum energy product | 24.4 | 25.1 | 25.9 | 24.9 | 23.2 |

| Hot press deformation parameters | | |
|---|---|---|
| Hot deformation temperature T1 | | Temperature T2 at both ends |
| 650° C. | | 240° C. |
| Maximum hot press pressure F | Pressure-rising time t1 | Heat and pressure preservation time t2 |
| 20 tons | 24 s | 60 s |

Examples 37-40

1. Preparation of precursor: Raw materials included permanent magnet powder and soft magnet powder. The permanent magnet powder was a mixture of $SmCo_5$ powder and $Nd_2Fe_{14}B$ powder in a mass ratio of 9:1. The soft magnet powder was a mixture of α-Fe powder and Co powder in a weight ratio of 65:35.

The mass fraction of the soft magnet powder in the raw material was adjusted according to Table 7. In an argon-protected glove box, the permanent magnet powder and the soft magnet powder were put into a ball mill jar, the ball to powder ratio of 20:1, and ball-milled on a SPEX ball mill for 4 hours to obtain a precursor.

Figure 16:
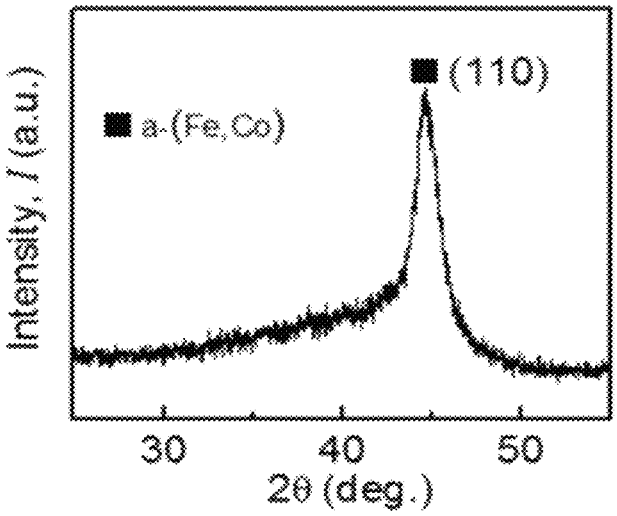
FIG. 16 is an XRD pattern of the precursor in Example 40.

The X-ray diffraction (XRD) pattern of the above precursor was as shown in FIG. 16, which showed only the diffraction peak of the α-Fe (Co) phase and no other diffraction peaks, indicating that the $SmCo_5$ and $Nd_2Fe_{14}B$ permanent magnet powder was amorphous.

2. Molding: the above precursor was molded at room temperature, to obtain a permanent magnet blank. The permanent magnet blank was a cylinder with a diameter of about 6 mm and a height of about 2 mm, which had a density of about 6.8-7.2 g/cm$^3$. Four permanent magnet blanks obtained above were placed in the mold as described in Examples 1-9. The permanent magnet blank and the mold in which the permanent magnet blank was placed together were collectively referred to as a hot press unit.

3. Hot press deformation: the hot press unit was subjected to hot press deformation using a Gleeble 3500 thermal simulation tester (Gleeble 3500 for short). Specifically, two carbide indenters were placed between heavy fixtures of the Gleeble 3500. The above hot press unit was clamped between the two carbide indenters for hot press deformation, with the axis of the hot press unit being parallel to the hot press pressure direction.

First, the hot press unit was clamped between the two carbide indenters for heating. At the same time, cooling water was charged at two electrodes of the Gleeble 3500, so that the temperatures at both ends of the hot press unit decreased. Under the double action of heating and cooling water treatment, a temperature gradient was formed in the hot press unit with a high temperature at the middle part and a low temperature at both ends in a direction parallel to the hot press pressure direction (i.e., the axial direction of the hot press unit). When the temperature of the middle part of the hot press unit reached the hot deformation temperature T1, and the temperature at both ends was T2, the hot press unit had not begun to deform. While maintaining the temperature of the middle part of the hot press unit at T1, and maintaining the cooling water conditions, the hot press pressure was gradually increased to the maximum hot press pressure F (unit: ton) within a period of time which was called pressure-rising time t1 (unit: s). During the pressure-rising, the hot press unit was deformed. Then, the hot press unit was preserved at the hot deformation temperature T1 and the maximum hot press pressure F for a period of time t2 (unit: s), then the temperature and the pressure were removed, to complete the hot press deformation. After the above hot press deformation, the deformation of the hot press unit in the hot press pressure direction was ε%.

Table 7 showed the weight contents (unit: wt %) of the soft magnet powder in the raw materials, the atomic percentages (unit: atomic %) of rare earth elements in the permanent magnet material, and various hot press deformation parameters as well as various magnetic property parameters of the permanent magnet material in a direction parallel to the hot press pressure direction in Examples 37-40.

Figure 17:
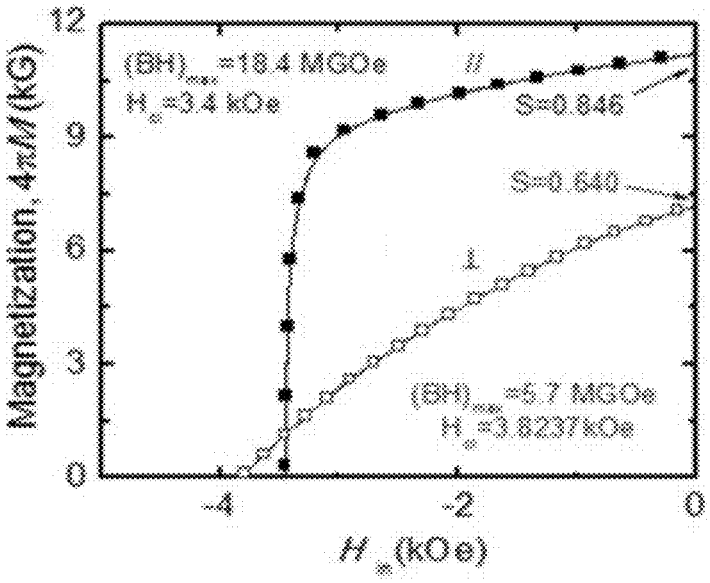
FIG. 17 is a demagnetization curve of the permanent magnet material in Example 40.

The magnetic hysteresis loop of the permanent magnet material of Example 40 in directions parallel to the hot press pressure direction (//) and perpendicular to the hot press pressure direction (⊥) was as shown in FIG. 17. From the data in the figure, it could be seen that the difference between the maximum energy product (18.4 MGOe) in a direction parallel to the hot press pressure direction and the maximum energy product (5.7 MGOe) in a direction perpendicular to the hot press pressure direction of the permanent magnet material was up to 12.7 MGOe; and the saturation magnetization in a direction parallel to the hot press pressure direction was significantly higher than the saturation magnetization in a direction perpendicular to the hot press pressure direction; the remanence ratio of 0.846 in a direction parallel to the hot press pressure direction was higher than the remanence ratio of 0.640 in a direction perpendicular to the hot press pressure direction. Therefore, the material has magnetic anisotropy.

Figure 18:
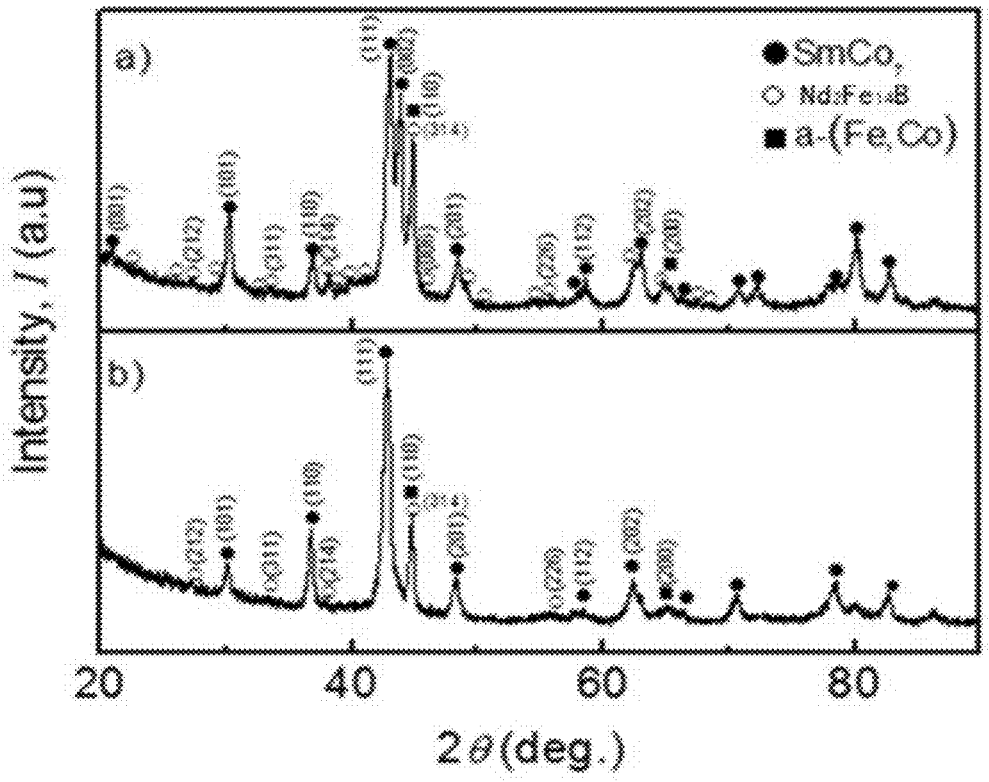
FIG. 18 is an XRD pattern of the permanent magnet material in Example 40.

The XRD pattern of the permanent magnet material of Example 40 was as shown in FIG. 18, wherein FIG. 18*a* and FIG. 18*b* respectively showed the XRD patterns of the faces perpendicular to and parallel to the hot press pressure direction. The permanent magnet material included three phases, i.e., $SmCo_7$, $Nd_2Fe_{14}B$ and α-Fe phases. As shown in FIG. 18*a*, (101), (110), (111), (002), (201) and other diffraction peaks of the $SmCo_7$ phase were present in the XRD pattern of the face perpendicular to the hot press pressure direction at 2θ angles of 30.5, 36.9, 43.3, 44.3, 48.7 degree. The (002) diffraction peak was significantly stronger with a relative intensity of 87%, the intensity being second only to that of the main diffraction peak (111). In contrast, the relative intensity of the $SmCo_7$ (002) diffraction peak recorded on the PDF card was only 30%. For the plane (110) perpendicular to the plane (002), the diffraction peak thereof had a relative intensity that was obviously lower than its relative intensity recorded on the PDF card. As shown in FIG. 18*b*, the (002) diffraction peak of the $SmCo_7$ phase disappeared completely for the XRD pattern of the face parallel to the hot press pressure direction. Thus, the easy magnetization direction (i.e. [001] direction) of the $SmCo_7$ grains in the permanent magnet material had a preferential orientation in a direction parallel to the hot press pressure direction, i.e., the permanent magnet material had a texture of [001] direction.

TABLE 7

| | Example | | | |
|---|---|---|---|---|
| | 37 | 38 | 39 | 40 |
| Soft magnet powder content (wt %) | 22% | 24% | 26% | 28% |
| Rare earth element content (atomic %) | 11.8% | 11.5% | 11.1% | 10.7% |
| Magnetic property parameters | | | | |
| Intrinsic coercivity | 3.9 | 3.6 | 3.9 | 3.4 |
| Saturation magnetization | 12.4 | 12.8 | 12.8 | 13.5 |
| Maximum energy product | 20.0 | 19.6 | 19.5 | 18.4 |

| Hot press deformation parameters | | | |
|---|---|---|---|
| Hot deformation temperature T1(° C.) | | Temperature T2 at both ends | |
| 700° C. | | 300° C. | |
| Maximum hot press pressure F | Pressure-rising time t1 | Heat and pressure preservation time t2 | Deformation ε% |
| 20 tons | 32 s | 60 s | 78% |

Examples 41-44

The raw materials were the same as those in Example 40, wherein the content of the soft magnet powder was 2 wt %, and the atomic percentage of the rare earth elements in the per magnet material was 10.7%.

Table 8 showed the hot deformation temperature, and other hot press deformation parameters, as well as various magnetic property parameters of the permanent magnet material Example 41-44. Please refer to Examples 37-40 with respect to other hot press deformation steps and parameters than the hot press deformation parameters defined in Table 8.

TABLE 8

| | Example | | | |
|---|---|---|---|---|
| | 41 | 42 | 43 | 44 |
| Hot deformation temperature T1 | 700° C. | 790° C. | 819° C. | 876° C. |
| Temperature T2 at both ends | 300° C. | 340° C. | 350° C. | 365° C. |
| Magnetic property parameters | | | | |
| Intrinsic coercivity | 3.8 | 3.7 | 3.5 | 3.2 |
| Saturation magnetization | 13.1 | 13.2 | 13.1 | 13.1 |
| Maximum energy product | 19.0 | 19.6 | 20.0 | 19.0 |

| Other hot press deformation parameters | | | |
|---|---|---|---|
| Maximum hot press pressure F | Pressure-rising time t1 | Heat ant pressure preservation time t2 | Deformation ε% |
| 20 tons | 35 s | 40 s | 80% |

Examples 45-48

The raw materials were the same as those in Example 40, wherein the content of the soft magnet powder was 28 wt %. During the hot press deformation, the hot deformation temperature was 650° C.; the deformation time was adjusted according to Table 9, the deformation was 80%; the heat and pressure preservation time was 40 s. Please refer to Examples 37-40 with respect to other parameters.

Table 9 showed the pressure-rising time (unit: s), and other hot press deformation parameters, as well as various magnetic property parameters of the permanent magnet material in a direction parallel to the hot press pressure direction in Examples 45-48.

TABLE 9

| | Example | | | |
|---|---|---|---|---|
| | 45 | 46 | 47 | 48 |
| Pressure-rising time t1 | 15 s | 30 s | 45 s | 60 s |
| Magnetic property parameters | | | | |
| Intrinsic coercivity | 3.7 | 3.9 | 3.8 | 3.8 |
| Saturation magnetization | 13.3 | 13.4 | 13.5 | 13.2 |
| Maximum energy product | 18.9 | 19.3 | 20.0 | 18.7 |

| Other hot press deformation parameters | | |
|---|---|---|
| Hot deformation temperature T1 | Temperature T2 at both ends | |
| 650° C. | 300° C. | |
| Maximum hot press pressure F | Heat and pressure preservation time t2 | Deformation ε% |
| 20 tons | 40 s | 80% |

Examples 49-51

The raw materials were the same as those in Example 40, wherein the content of the soft magnet powder was 28 wt %. During the hot press deformation, the hot deformation temperature was 650° C.; please refer to Examples 34-37 with respect to the hot mess pressure the pressure-rising time was 32 s, the deformation was adjusted according to Table 11, and the heat and pressure preservation nine was 40 s. Please refer to Examples 34-37 with respect to other steps and parameters. In this way, the permanent magnet materials of Examples 49-51 were obtained.

Table 10 showed the deformation (unit: %) after hot pressure deformation, and other hot press deformation parameters, as well as various magnetic property parameters of the permanent magnet material in a direction parallel to the hot press pressure direction in Examples 49-51. Please refer to Examples 37-40 with respect to other hot press deformation steps and parameters than the hot press deformation parameters defined in Table 10.

TABLE 10

| | Example | | |
|---|---|---|---|
| | 49 | 50 | 51 |
| Deformation | 75% | 77% | 80.25% |
| Magnetic property parameters | | | |
| Intrinsic coercivity | 3.6 | 3.9 | 3.5 |
| Saturation magnetization | 13.5 | 13.4 | 13.2 |
| Maximum energy product | 20.5 | 21.5 | 18.4 |

| Other hot press deformation parameters | | |
|---|---|---|
| Hot deformation temperature T1 | | Temperature T2 at both ends |
| 650° C. | | 300° C. |
| Maximum hot press pressure F | Pressure-rising time t1 | Heat an pressure preservation time t2 |
| 20 tons | 32 s | 40 s |

Finally, it should be noted that the foregoing examples are merely intended to describe the technical solution of the present disclosure rather than to limit the present disclosure. Although the present disclosure is described in detail with reference to the preferred examples, it shall be understood by a person skilled in the an that amendments to the specific embodiments of the present disclosure or equivalent replacements to certain technical features can still be made, without departing from the spirit of the technical solution of the present disclosure, all of which shall be encompassed within the scope of the technical solution for which protection is sought in the present disclosure.

The invention claimed is:

1. A method for preparing a permanent magnet material, the method comprising:

i) subjecting a hot press unit to hot press deformation, wherein the hot press unit consists of a permanent magnet blank and a mold in which the permanent magnet blank is placed; and ii) during the hot press deformation, subjecting the hot press unit to a cooling treatment at both ends along a hot press pressure direction, and the hot press unit has an axis being parallel to the hot press pressure direction;

the mold is made of a metal;

the mold is a cylindrical body having two open ends, and has an outer wall with a generatrix that is a concave curve, a straight line or a convex curve;

the hot press unit after the hot press deformation has a deformation in a direction parallel to the hot press pressure direction of 60-90%.

2. The method according to claim 1, comprising, during the hot press deformation, heating the hot press unit prior to deforming the hot press unit, while cooling both ends of the hot press unit in a certain cooling rate, so that temperature of a middle part of the hot press unit reaches a hot deformation temperature and both ends of the hot press unit have a temperature lower than the hot deformation temperature.

3. The method according to claim 1, wherein the cooling treatment is maintained during the hot press deformation.

4. The method according to claim 1, wherein the generatrix is a concave curve or a convex curve, which is an arc or a parabola.

5. The method according to claim 1, wherein said permanent magnet blank is formed by pressing a permanent magnet powder and a soft magnet powder.

6. The method according to claim 5, wherein the permanent magnet powder comprises at least one compound having a composition of $R_xT_y$, where R represents at least one rare earth element, T represents at least one transition metal element, $0<x<5$, and $0<y<30$, elements other than R and T are excluded, x and y denote to number of atoms.

7. The method according to claim 6, wherein the permanent magnet powder further comprises at least one compound having a composition of $R'_{x'}T'_{y'}M_{z'}$, where R' represents at least one rare earth element, T' represents at least one transition metal element, M represents at least one element of Groups IIIA, IVA, and VA, $0<x'<5$, $0<y'<30$, and $0<z'<25$, elements other than R', T' and M are excluded, x', y' and z' denote to number of atoms.

8. The method according to claim 5, wherein the permanent magnet powder comprises at least one compound having a composition of $R'_{x'}T'_{y'}M_{z'}$, where R' represents at least one rare earth element, T' represents at least one transition metal element, M represents at least one element of Groups IIIA, IVA, and VA, $0<x'<5$, $0<y'<30$, and $0<z'<25$, elements other than R', T' and M are excluded, x', y' and z' denote to number of atoms.

9. The method according to claim 5, wherein the soft magnet powder is selected from the group consisting of an elemental substance containing iron element, cobalt element or nickel element; a compound containing iron element, cobalt element and/or nickel element; an alloy containing iron element, cobalt element and/or nickel element; and any combination thereof.

10. The method according to claim 5, wherein the permanent magnet powder has an atomic ratio Sm: Co=1:5-6.

11. The method according to claim 5, wherein the permanent magnet powder has an atomic ratio Sm:Co:Fe:Cu:Zr=0.8-1.2:5-5.5:1-1.5:0.1-0.5:0.1-0.3;

or Sm:Co=1:5;

or Sm:Co:Nd:Fe:B=8-10:40-50:1-3:10-15:1-3.

12. The method according to claim 1, wherein the hot press deformation of the hot press unit is performed using an electric spark sintering system or a thermal simulation tester.

13. The method according to claim 12, wherein said subjecting ii) is performed by passing cooling water through two electrodes in the electric spark sintering system or the thermal simulation tester.

14. The method according to claim 1, optionally further comprising:

prior to said subjecting i), iii) mixing a permanent magnet powder and a soft magnet powder to obtain a mixture;

iv) molding the mixture of the permanent magnet powder and the soft magnet powder into the permanent magnet blank; and v) placing the permanent magnet blank in the mold to obtain the hot press unit; and after the hot press deformation, vi) subjecting the hot press unit to a stress relief treatment.

15. The method according to claim 14, wherein said mixing iii) is performed by ball-milling.

16. The method according to claim 15, wherein the permanent magnet powder is amorphous after the ball-milling.

17. The method according to claim 1, wherein at least one of the following is satisfied:

the hot press deformation is conducted at a hot deformation temperature of 400-900° C.;

temperature at both ends of the hot press unit is 300-600° C. lower than the hot deformation temperature; and temperature at both ends of the hot press unit is 100-400° C.

18. The method according to claim 1, wherein at least one of the following is satisfied:

a maximum hot press pressure applied during the deformation of the hot press unit is 15-25 tons;

during the deformation of the hot press unit, a middle part of the hot press unit reaches a hot deformation temperature of 500-800° C.;

during the deformation of the hot press unit, a pressure-rising time is 5-80 s; and during the deformation, after the hot press pressure reaches the maximum pressure, the hot press unit is held at the hot deformation temperature and the pressure for 1-60 s.

19. The method according to claim 1, wherein at least one of the following is satisfied:

the mold has a straight inner wall;

the mold has a height of 6-10 mm;

the mold has an inner diameter of 5-8 mm; and the mold has an outer diameter of 6-10 mm.

* * * * *